US011118821B2

(12) United States Patent
Matsuda et al.

(10) Patent No.: US 11,118,821 B2
(45) Date of Patent: Sep. 14, 2021

(54) REFRIGERATION CYCLE APPARATUS

(71) Applicant: Mitsubishi Electric Corporation, Tokyo (JP)

(72) Inventors: Takuya Matsuda, Tokyo (JP); Makoto Wada, Tokyo (JP); Yuji Motomura, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 153 days.

(21) Appl. No.: 16/464,081

(22) PCT Filed: Jan. 19, 2017

(86) PCT No.: PCT/JP2017/001766
§ 371 (c)(1),
(2) Date: May 24, 2019

(87) PCT Pub. No.: WO2018/134949
PCT Pub. Date: Jul. 26, 2018

(65) Prior Publication Data
US 2019/0331377 A1 Oct. 31, 2019

(51) Int. Cl.
*F25B 49/00* (2006.01)
*F24F 11/36* (2018.01)
*F25B 49/02* (2006.01)

(52) U.S. Cl.
CPC ..... *F25B 49/005* (2013.01); *F24F 11/36* (2018.01); *F25B 49/02* (2013.01); *F25B 2500/222* (2013.01)

(58) Field of Classification Search
CPC .. F25B 49/005; F25B 49/02; F25B 2500/222; F25B 13/00; F25B 2600/2519; F25B 5/02; F24F 11/58; F24F 11/36; F24F 11/52
See application file for complete search history.

(56) References Cited

U.S. PATENT DOCUMENTS 5,983,657 A * 11/1999 Murata ..... B60H 1/3225 62/129
6,073,455 A 6/2000 Tachigori et al.
(Continued)

FOREIGN PATENT DOCUMENTS

CN 1566826 A 1/2005
CN 105180498 A 12/2015
(Continued)

OTHER PUBLICATIONS

Extended European Search Report dated Jan. 7, 2020 in the corresponding EP patent application No. 17892453.6.
(Continued)

*Primary Examiner* — Kun Kai Ma
(74) *Attorney, Agent, or Firm* — Posz Law Group, PLC

(57) ABSTRACT

A space in which an indoor unit is disposed has its corresponding refrigerant leakage sensor. A remote control for the indoor unit has its corresponding information output device for notifying the user of information visually and/or aurally. When the refrigerant leakage sensor detects a leakage of refrigerant, an alarm outputs a warning sound and a safety measure device is activated. Further, the information output device outputs guidance information for notifying the user action to be taken after the safety measure device takes the safety measure. After outputting the guidance information, the information output device stops outputting the guidance information in response to completion of the user action.

16 Claims, 23 Drawing Sheets

(56) References Cited

U.S. PATENT DOCUMENTS

| | | | | |
|---|---|---|---|---|
| 9,791,195 | B2 * | 10/2017 | Okada | F24F 11/83 |
| 2005/0103029 | A1 | 5/2005 | Kawahara et al. | |
| 2009/0025406 | A1 * | 1/2009 | Yoshimi | F24F 11/83 62/127 |
| 2009/0107157 | A1 | 4/2009 | Dube | |
| 2013/0067942 | A1 * | 3/2013 | Ochiai | F25B 49/02 62/126 |
| 2014/0123685 | A1 * | 5/2014 | Kim | F25B 13/00 62/56 |
| 2016/0146488 | A1 * | 5/2016 | Ochiai | F24F 11/30 62/125 |
| 2016/0245566 | A1 * | 8/2016 | Hiraki | F25B 49/005 |
| 2017/0328620 | A1 * | 11/2017 | Ikawa | F24F 11/89 |
| 2018/0045424 | A1 * | 2/2018 | Yajima | F24F 11/30 |
| 2018/0094844 | A1 * | 4/2018 | Suzuki | F25B 13/00 |
| 2018/0106516 | A1 * | 4/2018 | Tanaka | F24F 11/77 |
| 2018/0283718 | A1 * | 10/2018 | Honda | F24F 11/77 |
| 2018/0283719 | A1 * | 10/2018 | Honda | F25B 49/02 |
| 2020/0049384 | A1 * | 2/2020 | Asanuma | F25B 49/005 |

FOREIGN PATENT DOCUMENTS

| | | | |
|---|---|---|---|
| EP | 2 292 986 | A2 | 3/2011 |
| EP | 2759787 | A1 | 7/2014 |
| JP | S62-077769 | U | 5/1987 |
| JP | S63-075455 | A | 4/1988 |
| JP | H03-080269 | U | 8/1991 |
| JP | H05-118720 | A | 5/1993 |
| JP | H05-164437 | A | 6/1993 |
| JP | H08-200904 | A | 8/1996 |
| JP | H09-264641 | B2 | 10/1997 |
| JP | H10-9692 | A | 1/1998 |
| JP | H11-230648 | A | 8/1999 |
| JP | 2003-207259 | A | 7/2003 |
| JP | 2004-278813 | A | 10/2004 |
| JP | 2011-027305 | A | 2/2011 |
| JP | 2015-094515 | A | 5/2015 |
| JP | 2015-206517 | A | 11/2015 |
| JP | 2016-166680 | A | 9/2016 |
| JP | 2016-211762 | A | 12/2016 |

OTHER PUBLICATIONS

Office Action dated Aug. 4, 2020 issued in the corresponding CN patent application No. 201780083139.9 (and English translation).
Office Action dated May 19, 2020 issued in the corresponding JP patent application No. 2018-562810 ( and English translation).
International Search Report of the International Searching Authority dated Apr. 11, 2017 for the corresponding International application No. PCT/JP2017/001766 (and English translation).
Office Action dated Jan. 5, 2021 issued in the corresponding JP patent application No. 2018-562810 (and English machine translation).

* cited by examiner

REFRIGERATION CYCLE APPARATUS

CROSS REFERENCE TO RELATED APPLICATION

This application is a U.S. national stage application of International Application PCT/JP2017/001766, filed on Jan. 19, 2017, the contents of which are incorporated herein by reference.

TECHNICAL FIELD

The present invention relates to a refrigeration cycle apparatus, and particularly to a refrigeration cycle apparatus including a refrigerant leakage detector corresponding to an indoor unit.

BACKGROUND

A refrigeration cycle apparatus performs air conditioning by heat exchange which involves liquefaction (condensation) and gasification (vaporization) of enclosed circulating refrigerant.

Japanese Patent Laying-Open No. 11-230648 (PTL 1) describes the control to notify the user of a leakage of refrigerant, when detected, and the action to be taken. Thus, the user can know the action to be taken after the detection of the leakage of refrigerant, and can quickly take the action after knowing the occurrence of the leakage of refrigerant. This achieves a high level of security.

PATENT LITERATURE

PTL 1: Japanese Patent Laying-Open No. 11-230648

PTL 1, however, merely describes notifying the user of the action to be taken but does not mention the control of subsequent notifications. Accordingly, the user cannot know whether or not they have taken appropriate action in accordance with the notification, and thus may feel uneasy. Thus, the user guidance in PTL 1 is not satisfactory in some aspects.

SUMMARY

The present invention has been made to solve such a problem. An object of the present invention is to provide a refrigeration cycle apparatus including a refrigerant leakage detector and capable of performing appropriate user guidance when a leakage of refrigerant is detected.

In one aspect of the present disclosure, a refrigeration cycle apparatus including an outdoor unit and at least one indoor unit comprises: a compressor, an outdoor heat exchanger provided in the outdoor unit, an indoor heat exchanger provided in the indoor unit, a refrigerant pipe, a leakage detector, an alarm, a safety measure device, a first information output unit, and a controller configured to control operation of the refrigeration cycle apparatus. The refrigerant pipe connects the compressor, the outdoor heat exchanger, and the indoor heat exchanger. The leakage detector is configured to detect a leakage of refrigerant flowing through the refrigerant pipe. The alarm is configured to emit a warning sound in response to detection of the leakage of refrigerant by the leakage detector. The safety measure device includes at least any of: a mechanical ventilation device configured to forcibly ventilate a space in which the indoor unit is disposed, a refrigerant shut-off device configured to shut off supply of the refrigerant to the space, and an agitating device configured to convect air in the space.

The first information output unit is configured to output information to a user corresponding to the indoor unit. The alarm and the safety measure device are configured to be activated when the leakage detector detects the leakage of refrigerant. The first information output unit is configured to output guidance information when the leakage detector detects the leakage of refrigerant, the guidance information being for notifying a user action to be taken after the safety measure device takes a safety measure. The first information output unit is configured to, after outputting the guidance information, stop outputting the guidance information in response to completion of the user action.

According to the above-described refrigeration cycle apparatus, when a leakage of refrigerant is detected by the refrigerant leakage detector, the alarm and the safety measure device are activated, and the first information output unit outputs the guidance information for notifying the user action to be taken after the safety measure device takes the safety measure. Further, after outputting the guidance information, the first information output unit stops outputting the guidance information in response to proper completion of the user action. Therefore, the user can know that the user action has been properly completed.

The present invention can provide appropriate user guidance when a leakage of refrigerant is detected, so as to prevent problems associated with an increase in concentration of refrigerant gas that would be caused by a continuing leakage of refrigerant in a poorly ventilated room.

DETAILED DESCRIPTION

Figure 1:
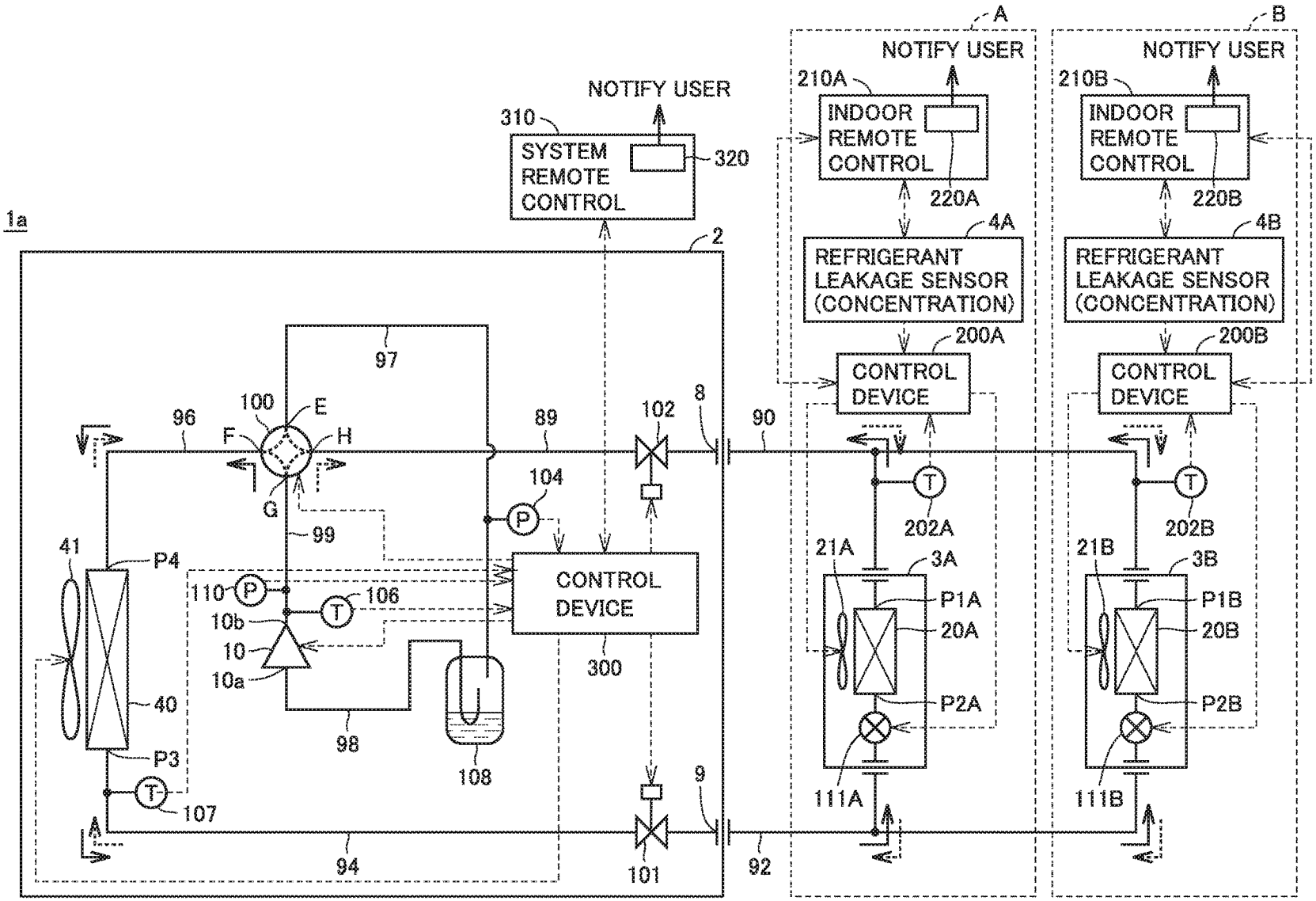
FIG. 1 is a block diagram showing a refrigerant circuit in a refrigeration cycle apparatus in embodiment 1.

Embodiments of the present invention are hereinafter described in detail with reference to the drawings. In the following, identical or corresponding components in the drawings are identically denoted, and the explanation of such components is not repeated in principle.

Embodiment 1

(Configuration of Apparatus)

FIG. 1 is a block diagram showing a refrigerant circuit in a refrigeration cycle apparatus 1*a* in embodiment 1.

With reference to FIG. 1, refrigeration cycle apparatus 1*a* includes an outdoor unit 2 and at least one indoor unit 3. Although FIG. 1 shows a configuration example in which two rooms A and B have their corresponding indoor units 3A and 3B, respectively, the number of indoor units 3 may be one, or may be three or more. Room A and room B correspond to one example of the "space" in which indoor units 3A and 3B are respectively disposed.

Rooms A and B have their corresponding refrigerant leakage sensors 4A and 4B, respectively. Each of refrigerant leakage sensors 4A, 4B is configured to detect the concentration of refrigerant gas in the atmosphere, for the refrigerant used in refrigeration cycle apparatus 1*a*. Alternatively, refrigerant leakage sensors 4A, 4B may be configured to detect the concentration of oxygen, so as to detect a decrease in concentration of oxygen caused by an increase in concentration of refrigerant gas. Each of refrigerant leakage sensors 4A, 4B corresponds to the "leakage detector" of refrigerant.

For example, refrigerant leakage sensors 4A and 4B can be disposed in the inside of rooms A and B, including the inside of indoor units 3A, 3B. Alternatively, refrigerant leakage sensors 4A and 4B can be disposed in, for example, ducts (not shown). That is, the location of refrigerant leakage sensors 4A and 4B is not limited to the inside of rooms A and B, but may be any location that allows refrigerant leakage sensors 4A and 4B to detect the concentration of refrigerant gas in rooms A and B, respectively.

In the following, the elements provided for rooms A, B (indoor units 3A, 3B) are denoted by reference numbers with no suffix when the description is common to the rooms; whereas the elements are denoted by reference numbers with suffixes A and B when the rooms are distinguished from each other. For example, each of refrigerant leakage sensors 4A, 4B is also denoted simply by refrigerant leakage sensor 4 when a matter common to refrigerant leakage sensors 4A, 4B is described.

Outdoor unit 2 in refrigeration cycle apparatus 1*a* includes: a compressor 10; an outdoor heat exchanger 40; an outdoor fan 41; a four-way valve 100; an accumulator 108; a control device 300 to control the operation of the outdoor unit; shut-off valves 101, 102; and pipes 89, 94, 96 to 99. Four-way valve 100 has ports E, F, G, and H.

Outdoor heat exchanger 40 has ports P3 and P4.

Indoor unit 3A includes an indoor heat exchanger 20A, an indoor fan 21A, and an electronic expansion valve (LEV) 111A. Similarly, indoor unit 3B includes an indoor heat exchanger 20B, an indoor fan 21B, and an LEV 111B. Indoor heat exchanger 20A has ports HA and P2A. Indoor heat exchanger 20B has ports P1B and P2B.

Indoor unit 3A has its corresponding control device 200A for controlling the operation of indoor unit 3A. Indoor unit 3B has its corresponding control device 200B for controlling the operation of indoor unit 3B. Control devices 200A, 200B may be built in indoor units 3A, 3B.

Control device 200 for the indoor unit and control device 300 for the outdoor unit each include, for example, a central processing unit (CPU), a storage device, and an input-output buffer (none of which are shown). Control devices 200, 300 control the operation of various devices in outdoor unit 2 and various devices in indoor unit 3. Although the present embodiment describes control device 200 for the indoor unit and control device 300 for the outdoor unit as separate elements, the control functions can be centralized. That is, in the present embodiment, the integrated functions of control devices 200, 300 correspond to one example of the "controller".

Further, refrigeration cycle apparatus 1*a* has a system remote control 310 as a remote control that receives the user's operational input for the entire operation of refrigeration cycle apparatus 1*a*. Refrigeration cycle apparatus 1*a* also has an indoor remote control 210 corresponding to each indoor unit. In the example in FIG. 1, indoor units 3A, 3B have their corresponding indoor remote controls 210A, 210B, respectively. Indoor remote controls 210A, 210B are disposed, for example, inside rooms A, B. System remote control 310 can be disposed near outdoor unit 2.

In particular, if refrigeration cycle apparatus 1*a* is disposed in a building as a multi air conditioning system for example, system remote control 310 can be disposed in an operation administrative room in which a maintenance administrator stays (not shown) for refrigeration cycle apparatus 1*a*, for centralized control of a plurality of indoor units 3. Thus, system remote control 310 can be disposed near outdoor unit 2 and/or in an operation administrative room for refrigeration cycle apparatus 1*a*.

Indoor remote control 210 has functions with which the user can input the operation instruction related to the operation of corresponding indoor unit 3. For example, indoor remote control 210A can receive input of the operation instruction related to the operation of indoor unit 3A. Examples of the operation instruction include an instruction for activation/stop, an instruction for setting the timer operation, an instruction for selecting the operation mode, and an instruction for setting the temperature.

Further, indoor remote control 210 has an information output device 220 to notify the user of information by outputting a message visually and/or aurally. For example, an information output device 220A is provided on the surface of or outside indoor remote control 210A. Similarly, an information output device 220B is provided on the surface of or outside indoor remote control 210B. Information output device 220 may be provided separately from indoor remote control 210. For example, information output device 220 can be provided in indoor unit 3.

System remote control 310 may be configured to receive input from the user (including a maintenance administrator or serviceman, for example), for not only the operation instruction for outdoor unit 2, but also the operation instruction for the entire refrigeration cycle apparatus 1*a* and/or the operation instruction for each indoor unit 3. An information output device 320, similar to information output device 220, is provided on the surface of or outside system remote control 310. That is, system remote control 310 can also notify the user of information by outputting a message visually and/or aurally.

Next, the configuration of outdoor unit 2 and indoor unit 3 is described in more detail.

Pipe 89 connects port H of four-way valve 100 to a gas-side refrigerant pipe connecting port 8 of outdoor unit. Pipe 89 has a shut-off valve 102 (gas shut-off valve). To gas-side refrigerant pipe connecting port 8, one end of an extension pipe 90 is connected outside the outdoor unit. The other end of extension pipe 90 is connected to one port of indoor heat exchanger 20 of each indoor unit 3. That is, in the example in FIG. 1, one end of extension pipe 90 is connected to ports P1A, P1B.

Inside indoor unit 3, indoor heat exchanger 20 is connected to LEV 111. In the example in FIG. 1, indoor heat exchanger 20A is connected to LEV 111A inside indoor unit 3A, and indoor heat exchanger 20B is connected to LEV 111B inside indoor unit 3B.

Inside indoor unit 3, a temperature sensor 202 is provided to detect a refrigerant temperature on the gas side (the side on which ports P1A, P1B are disposed) relative to indoor heat exchanger 20. In the example in FIG. 1, indoor heat exchangers 20A and 20B have their corresponding temperature sensors 202A and 202B, respectively. The detection value from temperature sensor 202 (202A, 202B) is sent to control device 200.

Pipe 94 connects a liquid-side refrigerant pipe connecting port 9 of the outdoor unit to port P3 of outdoor heat exchanger 40. Pipe 94 has a shut-off valve 101 (liquid shut-off valve). To liquid-side refrigerant pipe connecting port 9, one end of an extension pipe 92 is connected outside the outdoor unit. The other end of extension pipe 92 is connected to one port of indoor heat exchanger 20 of each indoor unit 3. That is, in the example in FIG. 1, one end of extension pipe 92 is connected to ports P2A, P2B. Pipe 96 connects port P4 of outdoor heat exchanger 40 to port F of four-way valve 100. The refrigerant outlet 10*b* of compressor 10 is connected to port G of four-way valve 100.

Pipe 98 connects the refrigerant inlet 10*a* of compressor 10 to the refrigerant outlet of accumulator 108. Pipe 97 connects the refrigerant inlet of accumulator 108 to port E of four-way valve 100. Pipe 99 connects refrigerant outlet 10*b* of compressor 10 to port G of four-way valve 100. Pipe 99 has a temperature sensor 106 and a pressure sensor 110, placed halfway on pipe 99, so as to measure the refrigerant temperature and the refrigerant pressure on the output side (high-pressure side) relative to compressor 10. In the configuration example in FIG. 1, pipes 89, 94, 96 to 99 and extension pipes 90, 92 constitute the "refrigerant pipe" connecting compressor 10, outdoor heat exchanger 40, and indoor heat exchanger 20 (20A, 20B).

Outdoor unit 2 further includes a pressure sensor 104 and a temperature sensor 107. Temperature sensor 107 is provided in pipe 94 to detect the refrigerant temperature on the liquid side (port P3) relative to outdoor heat exchanger 40. Pressure sensor 104 is provided to detect the refrigerant pressure on the input side (low-pressure side) relative to compressor 10. The detection values from pressure sensors 104, 110 and temperature sensors 106, 107 are sent to control device 300.

Compressor 10 is configured to change its operating frequency by the control signal from control device 300. By changing the operating frequency of compressor 10, the output from compressor is adjusted. Various types of compressors 10 can be employed, such as rotary compressors, reciprocating compressors, scroll compressors, and screw compressors.

In indoor unit 3 (3A, 3B), in accordance with the control signal from control device 200 (200A, 200B), the degree of opening of LEV 111 (111A, 111B) is controlled, so that LEV 111 is in any one of the following states: being fully open, performing superheat (SH) control, performing subcooling (SC) control, or being closed.

Four-way valve 100 is controlled into any of state 1 (cooling operation state) and state 2 (heating operation state), in accordance with the control signal from control device 300. In state 1, four-way valve 100 is controlled so that port E communicates with port H and so that port F communicates with port G.

Thus, operating compressor 10 in state 1 (cooling operation state) forms the circulation pathway of refrigerant in the direction indicated by the solid line arrows, in the example in FIG. 1. Specifically, the refrigerant that has been changed into high-temperature, high-pressure vapor by compressor 10 flows from refrigerant outlet 10*b* through pipes 99 and 96 and outdoor heat exchanger 40, thus condensing (liquefying) by radiating heat at outdoor heat exchanger 40.

After that, the refrigerant flows through pipe 94, extension pipe 92, LEV 111, and indoor heat exchanger 20, thus vaporizing (gasifying) by absorbing heat at indoor heat exchanger 20. Further, the refrigerant returns to refrigerant inlet 10*a* of compressor 10 via extension pipe 90, pipe 89, and accumulator 108. Thus, the space in which indoor unit 3 is disposed (e.g., rooms A, B in which indoor units 3A, 3B are disposed) is cooled.

On the other hand, in state 2 (heating operation state), four-way valve 100 is controlled so that port G communicates with port H and so that port E communicates with port F. Operating compressor 10 in state 2 forms the circulation pathway of refrigerant in the direction indicated by the broken line arrows in the drawing. Specifically, the refrigerant that has been changed into high-temperature, high-pressure vapor by compressor 10 flows from refrigerant outlet 10*b* through pipes 99 and 89, extension pipe 90, and the indoor heat exchanger, thus condensing (liquefying) by radiating heat at indoor heat exchanger 20.

After that, the refrigerant flows through LEV 111, extension pipe 92, pipe 94, and outdoor heat exchanger 40 in this order, thus vaporizing (gasifying) by absorbing heat at outdoor heat exchanger 40. Further, the refrigerant returns to refrigerant inlet 10*a* of compressor 10 via pipes 96, 97 and accumulator 108. Thus, the space (rooms A, B) in which indoor unit 3 (3A, 3B) is disposed is heated.

In both of state 1 and state 2, pipe 94, which has shut-off valve 101 for shutting off the liquid refrigerant, is provided in a pathway that connects outdoor heat exchanger 40 and indoor heat exchanger 20 not via compressor 10 in the circulation pathway of refrigerant. That is, shut-off valve 101 corresponds to one example of the "first shut-off valve". Shut-off valve 101 can be disposed on extension pipe 92, in which case shut-off valve 101 can also function as a liquid shut-off valve.

In both of state 1 and state 2, pipe 89, which has shut-off valve 102 for shutting off the gas refrigerant, is provided in a pathway that connects outdoor heat exchanger 40 and indoor heat exchanger 20 via compressor 10 in the circulation pathway of refrigerant. That is, shut-off valve 102 corresponds to one example of the "second shut-off valve". Shut-off valve 102 can be disposed on extension pipe 90, in which case shut-off valve 102 can also function as a liquid shut-off valve.

In the example in FIG. 1, the opening and closing of each of shut-off valves 101, 102 is automatically controlled by control device 300. For example, shut-off valves 101, 102 can be solenoid valves which are controlled to be opened and closed by turning on and off electricity in an exciting circuit, in accordance with the control signal from control device 300. In particular, if the solenoid valve is of a type that is opened when electricity is turned on and that is closed when electricity is turned off, interruption of power supply can close shut-off valves 101, 102 to shut off the refrigerant.

Figure 2:
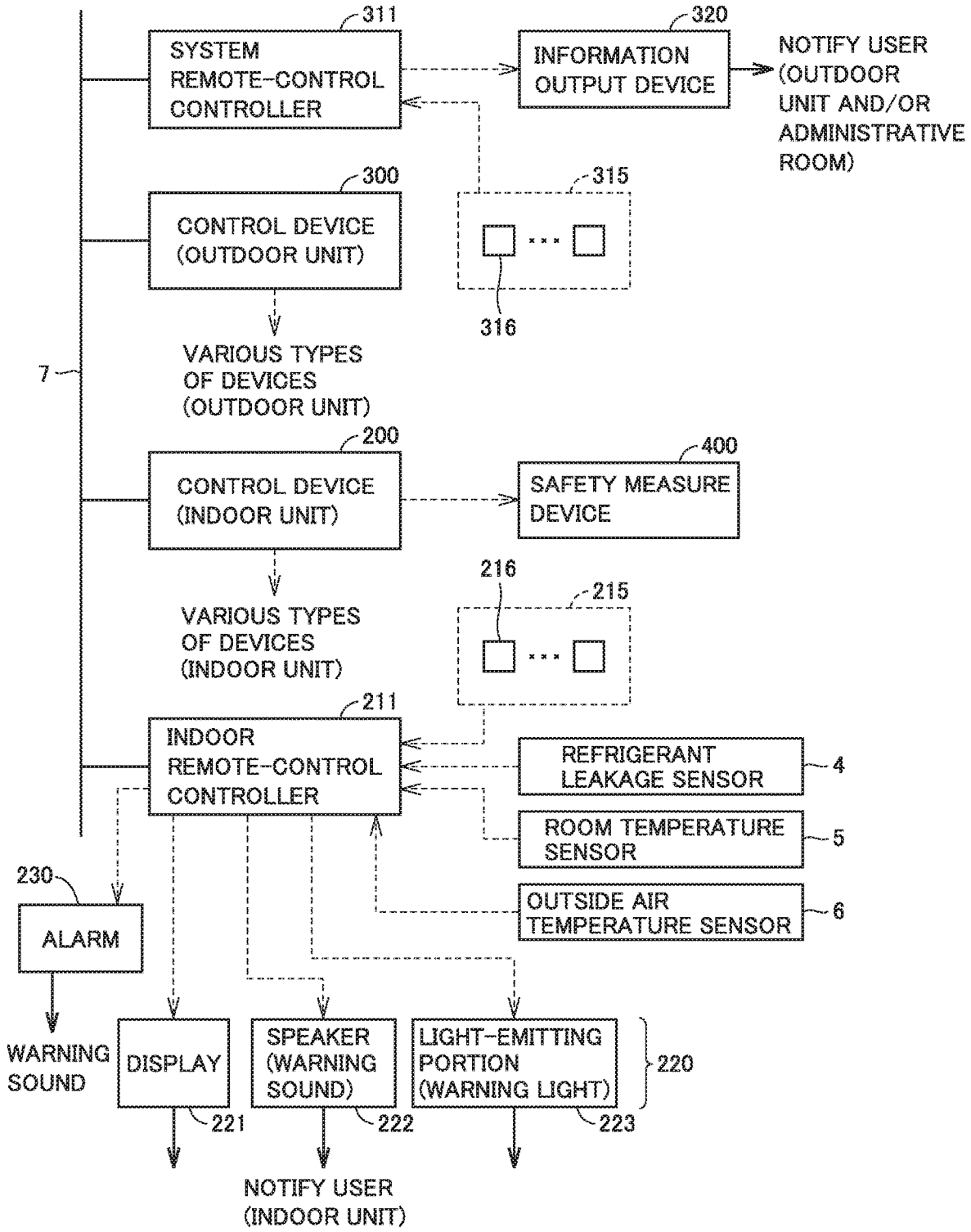
FIG. 2 is a schematic block diagram of a control configuration formed by a control device, a system remote control, and an indoor remote control in the refrigeration cycle apparatus shown in FIG. 1.

FIG. 2 shows a schematic block diagram of a control configuration formed by control devices 200, 300, the system remote control, and the indoor remote control in refrigeration cycle apparatus 1*a*.

With reference to FIG. 2, system remote control 310 (FIG. 1) includes a system remote-control controller 311, and indoor remote control 210 (FIG. 1) includes an indoor remote-control controller 211. Each of system remote-control controller 311 and indoor remote-control controller 211 can be, for example, a microcomputer.

Control device 300 of outdoor unit 2, control device 200 of indoor unit 3, indoor remote-control controller 211, and system remote-control controller 311 are configured to communicate with one another via a communication path 7. Communication path 7 can be formed by wired communication (e.g., by communication cable) or wireless communication. Thus, signals and data can be exchanged among control device 200, control device 300, system remote control 310, and indoor remote control 210.

Information output device 220 corresponding to indoor unit 3 includes at least one of a display 221, a speaker 222, and a light-emitting portion 223. Display 221 is typically a liquid crystal panel, and can output visual messages (e.g., text information and illustration information) to the user. The content on display 221 is controlled by indoor remote-control controller 211.

Speaker 222 can output aural messages (e.g., warning sounds and voices) to the user, in accordance with the control signal from indoor remote-control controller 211. Light-emitting portion 223 is typically warning light by a light emitting diode (LED), and can output visual messages to the user by, for example, flashing or turning-on of the warning light.

Thus, indoor remote-control controller 211 can notify the user of information visually and/or aurally using information output device 220. Although not shown, information output device 320, corresponding to outdoor unit 2, is configured similar to information output device 220. That is, outdoor unit 2 can also notify the user of information using information output device 320.

An operation input unit 215 receives input of the user operation, and transmits it to indoor remote-control controller 211. Operation input unit 215 includes a plurality of operation switches 216. Operation switches 216 are used to input the above-described operation instructions (e.g., the instructions for activation/stop, for setting the timer operation, for selecting the operation mode, and for setting the temperature). Operation switches 216 may be, for example, push switches provided on the casing of indoor remote control 210. Alternatively, at least a part of operation switches 216 can be a softswitch on the touch panel which constitutes display 221.

Similarly, the user can also input the operation instructions to system remote-control controller 311 via an operation input unit 315 including a plurality of operation switches 316. Operation input unit 315 can be similar to operation input unit 215 in configuration.

Control devices 200 and 300 control the operation of outdoor unit 2 and indoor unit 3, so as to operate refrigeration cycle apparatus 1*a* in accordance with the user's operation instruction inputted to system remote control 310 and indoor remote control 210 using operation input units 215 and 315.

Indoor remote-control controller 211 receives input of the concentration detection value from refrigerant leakage sensor 4 shown in FIG. 1. Further, indoor remote-control controller 211 also receives input of the temperature detection values from a room temperature sensor 5 and an outside air temperature sensor 6. Room temperature sensor 5 is a sensor for measuring the temperature in the space in which indoor unit 3 is disposed. Outside air temperature sensor 6 is a sensor for measuring the temperature of the outside air. Refrigerant leakage sensor 4 and room temperature sensor 5 may be built in indoor remote control 210 (FIG. 1). Indoor remote-control controller 211 can notify the user of information by controlling information output device 220 based on the detection values from refrigerant leakage sensor 4, room temperature sensor 5, and outside air temperature sensor 6.

(Control Operation of When Leakage of Refrigerant is Detected)

Next, the control of when a leakage of refrigerant is detected by refrigerant leakage sensor 4 in refrigeration cycle apparatus 1*a* is described.

As shown in FIG. 2, refrigeration cycle apparatus 1*a* further includes an alarm 230 and a safety measure device 400 which are activated when a leakage of refrigerant is detected. Under the control of indoor remote-control controller 211, alarm 230 is configured to emit at least a warning sound when a leakage of refrigerant is detected by refrigerant leakage sensor 4. Alarm 230 may also be configured to turn on or flash a warning light, in addition to emitting the warning sound.

Alarm 230 may be provided integrally with indoor remote control 210, or may be provided as a device separate from indoor remote control 210. If alarm 230 is provided integrally with indoor remote control 210, a part of information output device 220 can provide the function of alarm 230.

Safety measure device 400 can be provided in conformity with the JRA standards by the Japan Refrigeration and Air Conditioning Industry Association. For example, safety measure device 400 can include at least any one of (a part or all of) a mechanical ventilation device, a refrigerant shut-off device, and an agitating device.

Figure 3:
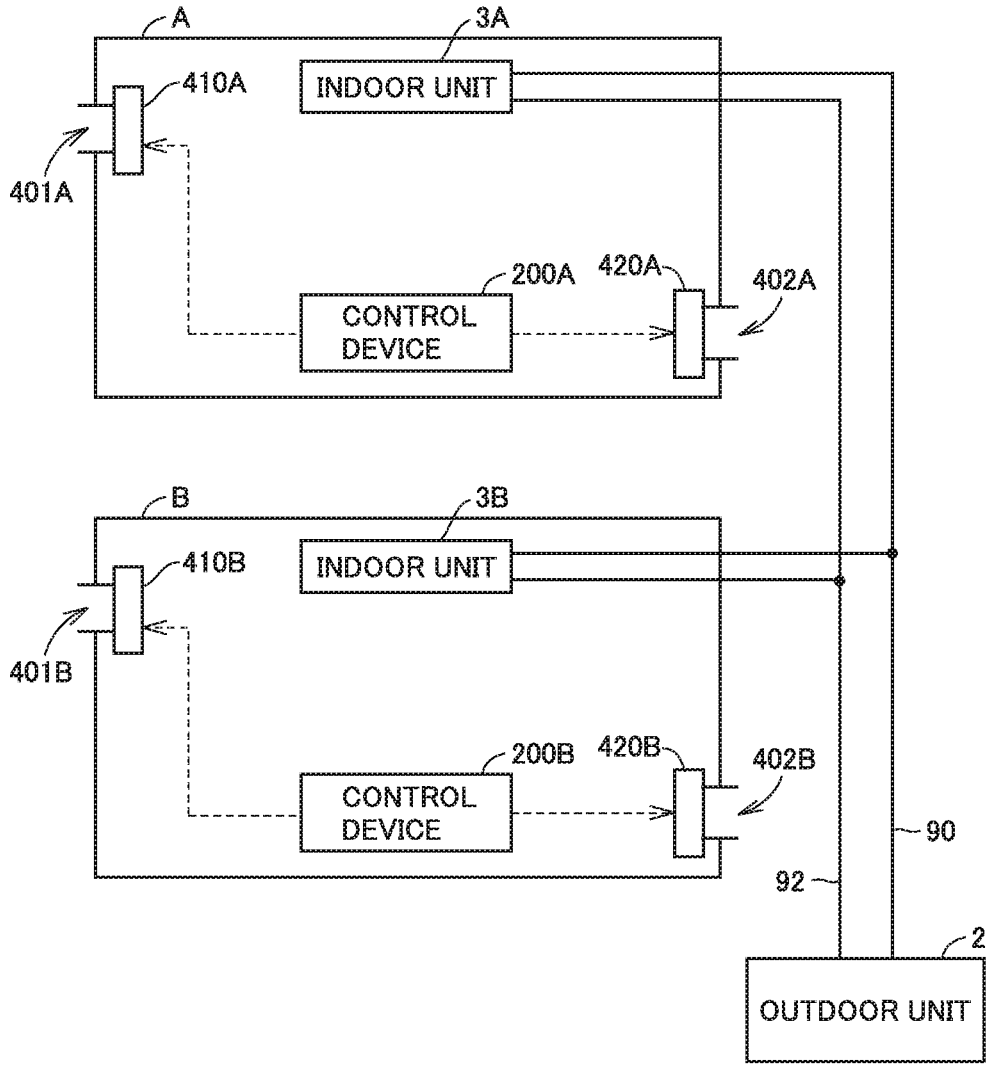
FIG. 3 is a block diagram explaining a first configuration example of the safety measure device shown in FIG. 2.

FIG. 3 shows a case in which a mechanical ventilation device is provided as a first configuration example of the safety measure device.

With reference to FIG. 3, an intake port 401A and an exhaust port 402A at room A have their corresponding ventilation device 410A and opening-closing mechanism 420A, respectively. Ventilation device 410A and opening-closing mechanism 420A have a wired or wireless communication path for communicating with control device 200A. Typically, ventilation device 410A is a ventilating fan which is activated in response to the instruction from control device 200A when a leakage of refrigerant is detected by refrigerant leakage sensor 4.

Similarly, opening-closing mechanism 420A is configured to open exhaust port 402A in response to the instruction from control device 200A when a leakage of refrigerant is detected by refrigerant leakage sensor 4A. Thus, room A can be ventilated by activating ventilation device 410A and/or opening-closing mechanism 420A.

Similarly, room B has an intake port 401B and an exhaust port 402B similar to intake port 401A and exhaust port 402A, and a ventilation device 410B and an opening-closing mechanism 420B similar to ventilation device 410A and opening-closing mechanism 420A. Control device 200B can ventilate room B by activating ventilation device 410B and/or opening-closing mechanism 420B when a leakage of refrigerant is detected by refrigerant leakage sensor 4B.

Thus, the combination of intake port 401 and ventilation device 410, and/or the combination of exhaust port 402 and opening-closing mechanism 420 can serve as a mechanical ventilation device to forcibly ventilate the space (rooms A, B) in which indoor unit 3 is disposed. The above-described mechanical ventilation device is not necessarily a device dedicated to refrigeration cycle apparatus 1*a*. Instead, the above-described mechanical ventilation device can be a general indoor ventilation device that is designed to be activated in response to the instruction from control device 200. If the mechanical ventilation device is being activated at the point of time at which a leakage of refrigerant is detected by refrigerant leakage sensor 4, control device 200 does not have to produce a further activation instruction.

Figure 4:
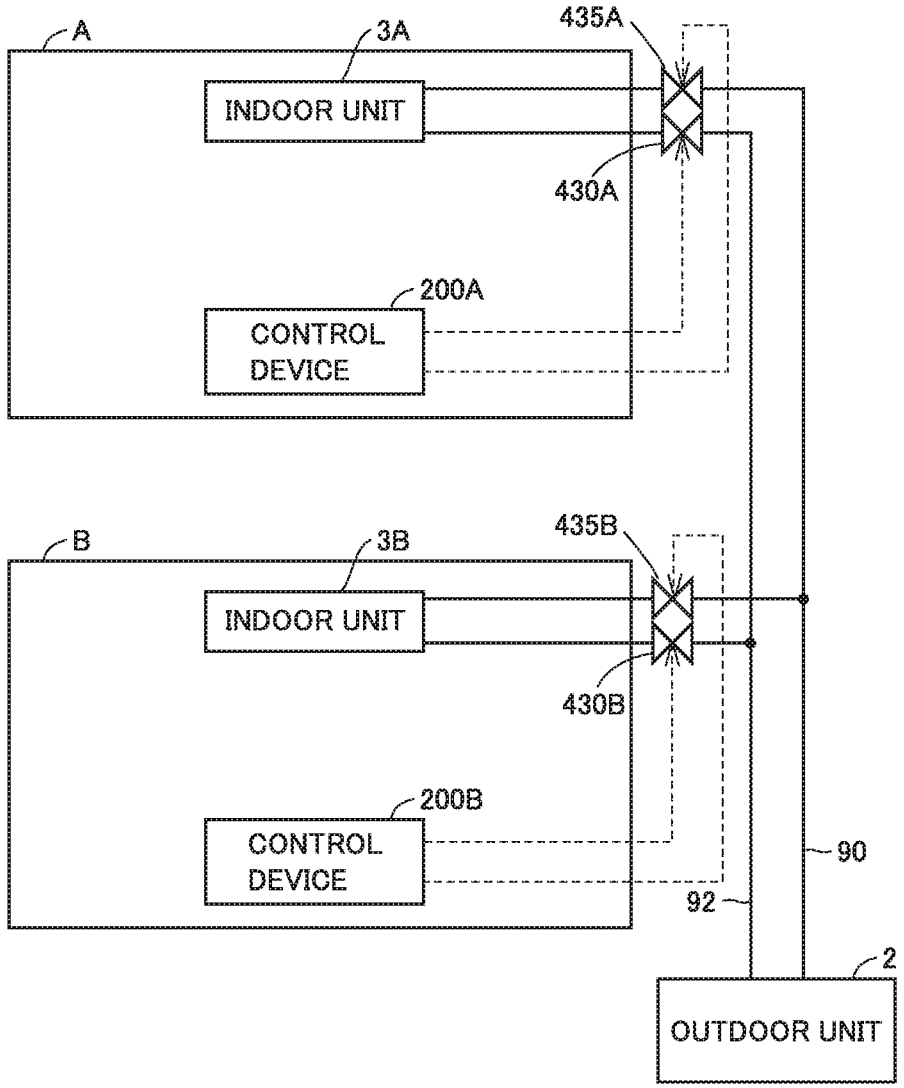
FIG. 4 is a block diagram explaining a second configuration example of the safety measure device shown in FIG. 2.

FIG. 4 shows a case in which a refrigerant shut-off device is provided as a second configuration example of the safety measure device.

With reference to FIG. 4, indoor unit 3A has its corresponding shut-off valves 430A and 435A provided outside room A. Shut-off valve 430A is provided for the port of indoor unit 3A adjacent to extension pipe 92, and shut-off valve 435A is provided for the port of indoor unit 3A adjacent to extension pipe 90.

Shut-off valves 430A and 435A, which are solenoid valves for example, are opened and closed in response to the instruction from control device 200A. Control device 200A can shut off supply of refrigerant to indoor unit 3A by closing shut-off valves 430A and 435A when a leakage of refrigerant is detected by refrigerant leakage sensor 4A.

Similarly, room B has shut-off valves 430B and 435B outside room B, as with shut-off valves 430A and 435A. Shut-off valves 430B and 435B, which are solenoid valves for example, are opened and closed in response to the instruction from control device 200B. Control device 200B can shut off supply of refrigerant to indoor unit 3B by closing shut-off valves 430B and 435B when a leakage of refrigerant is detected by refrigerant leakage sensor 4B.

Thus, shut-off valves 430 and 435 for indoor unit 3 can provide a refrigerant shut-off device to shut off supply of refrigerant to the space (rooms A, B) in which indoor unit 3 is disposed.

Figure 5:
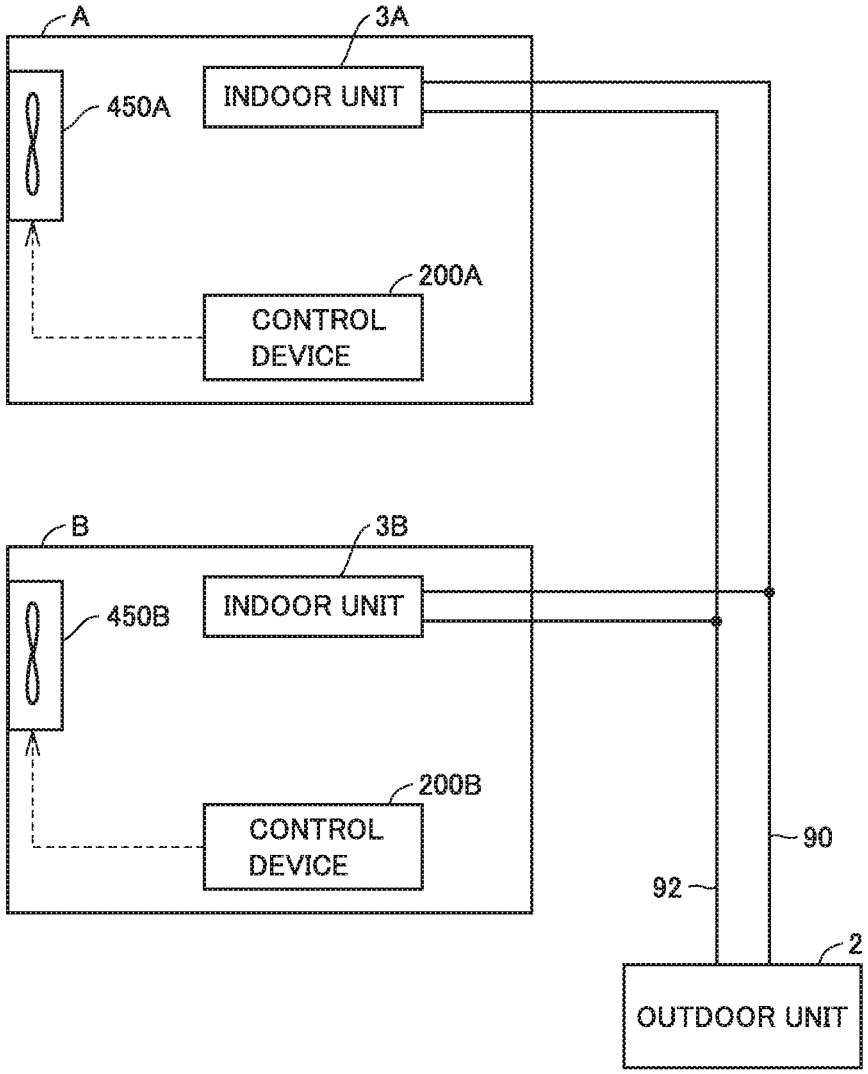
FIG. 5 is a block diagram explaining a third configuration example of the safety measure device shown in FIG. 2.

FIG. 5 shows a case in which an agitating device is provided as a third configuration example of the safety measure device.

With reference to FIG. 5, room A has an agitator 450A to convect indoor air. Agitator 450A has a wired or wireless communication path for communicating with control device 200A. Typically, agitator 450A can be a ceiling fan or circulator which is activated in response to the instruction from control device 200A when a leakage of refrigerant is detected by refrigerant leakage sensor 4A.

Similarly, room B has an agitator 450B to convect indoor air. Agitator 450B can be a ceiling fan or circulator which is activated in response to the instruction from control device 200B when a leakage of refrigerant is detected by refrigerant leakage sensor 4B.

Thus, agitator 450 can constitute an agitating device to convect air in the space (rooms A, B) in which indoor unit 3 is disposed. The agitating device is not necessarily a device dedicated to refrigeration cycle apparatus 1*a*. Instead, the agitating device can be a general air agitation device that is designed to be activated in response to the instruction from control device 200. Alternatively, the agitating device can be formed by indoor fan 21A of indoor unit 3 activated when a leakage of refrigerant is detected by refrigerant leakage sensor 4A.

The capacity and location of the above-described mechanical ventilation device, refrigerant shut-off device, and agitating device can be determined in conformity with the JRA standards. At least any one of (a part or all of) the mechanical ventilation device, the refrigerant shut-off device, and the agitating device can serve as safety measure device 400 that is activated to take the safety measure when a leakage of refrigerant is detected.

Figure 6:
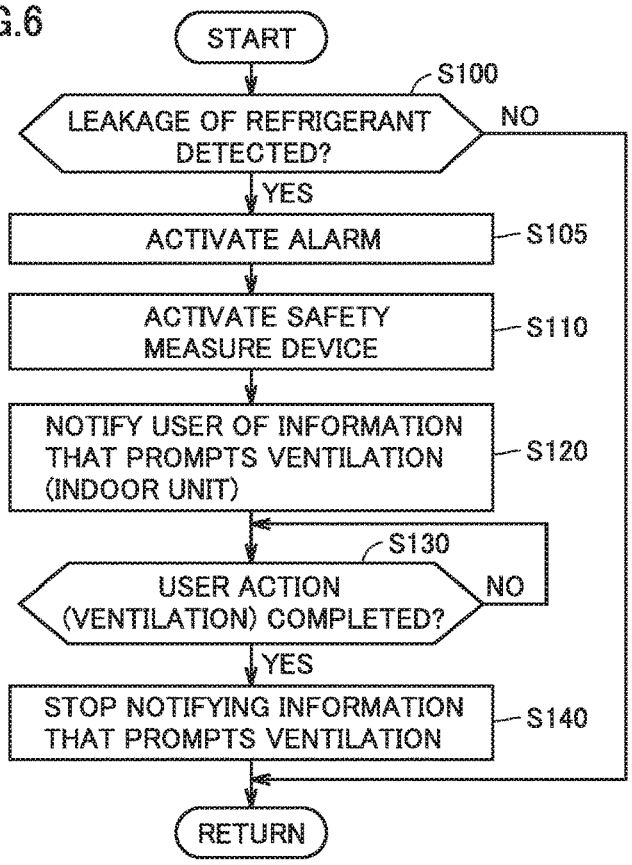
FIG. 6 is a flowchart explaining a control process of when a leakage of refrigerant is detected by a refrigerant leakage sensor.

FIG. 6 is a flowchart explaining a control process of when a leakage of refrigerant is detected by refrigerant leakage sensor 4. The control process shown in FIG. 6 can be executed by control device 200 corresponding to indoor unit 3, for example.

Control device 200 detects, by step S100, whether or not a leakage of refrigerant has occurred, based on the detection value from refrigerant leakage sensor 4. When a leakage of refrigerant is detected (YES at S100), the detection acts as a trigger to start the processes at and after step S105. On the other hand, when a leakage of refrigerant is not detected (NO at S100), the processes at and after step S110 are not started. Accordingly, control device 200 can execute the control process shown in FIG. 6 by starting the control process in response to detection of a leakage of refrigerant.

When a leakage of refrigerant is detected (YES at S100), control device 200 activates alarm 230 by step S105. This causes alarm 230 to output at least a warning sound to the user corresponding to indoor unit 3.

Further, control device 200 activates safety measure device 400 by step S110. This causes at least any one of the mechanical ventilation device, the refrigerant shut-off device, and the agitating device to take the safety measure in conformity with the JRA standards.

In particular, if the function of safety measure device 400 is performed by a pump down operation (described later), the occurrence of leakage of refrigerant is notified to outdoor unit 2 (system remote control 310), as a part of the process of step S110.

By step S120, control device 200 further notifies the user (corresponding to indoor unit 3) of information that prompts indoor ventilation, through at least one of aural information and visual information from information output device 220 corresponding to indoor remote control 210.

As the aural information, a warning sound and/or a voice message (e.g., "open the window") can be outputted by speaker 222. As the visual information, light-emitting portion 223 provided as a warning light can be turned on or flashed, or a message that prompts ventilation can be outputted by display 221.

The information that prompts ventilation notified to the user at step S120 corresponds to the "guidance information", and more particularly corresponds to one example of the "first information". The processes of steps S105, S110, S120 may be executed simultaneously or successively after step S100.

An instruction for stopping the notification of information by step S120 can be inputted through a specific switch among a plurality of operation switches 216 of indoor remote control 210. In this case, the information notified at step S130 preferably includes a message that prompts operation of the specific switch at the time of completion of ventilation. This specific switch corresponds to one example of the "first operation unit". Instead of the specific switch among a plurality of operation switches 216 of indoor remote control 210, a switch (not shown) provided in indoor unit 3 may be operated to input the instruction for stopping the notification of information by step S120.

After control device 200 notifies the information that prompts ventilation by step S120, control device 200 determines, by step S130, whether or not the user action (ventilation) has completed. Until the completion of the user action is detected (NO at S130), the process of step S120 is repeated to continue outputting the information that prompts ventilation.

Figure 7:
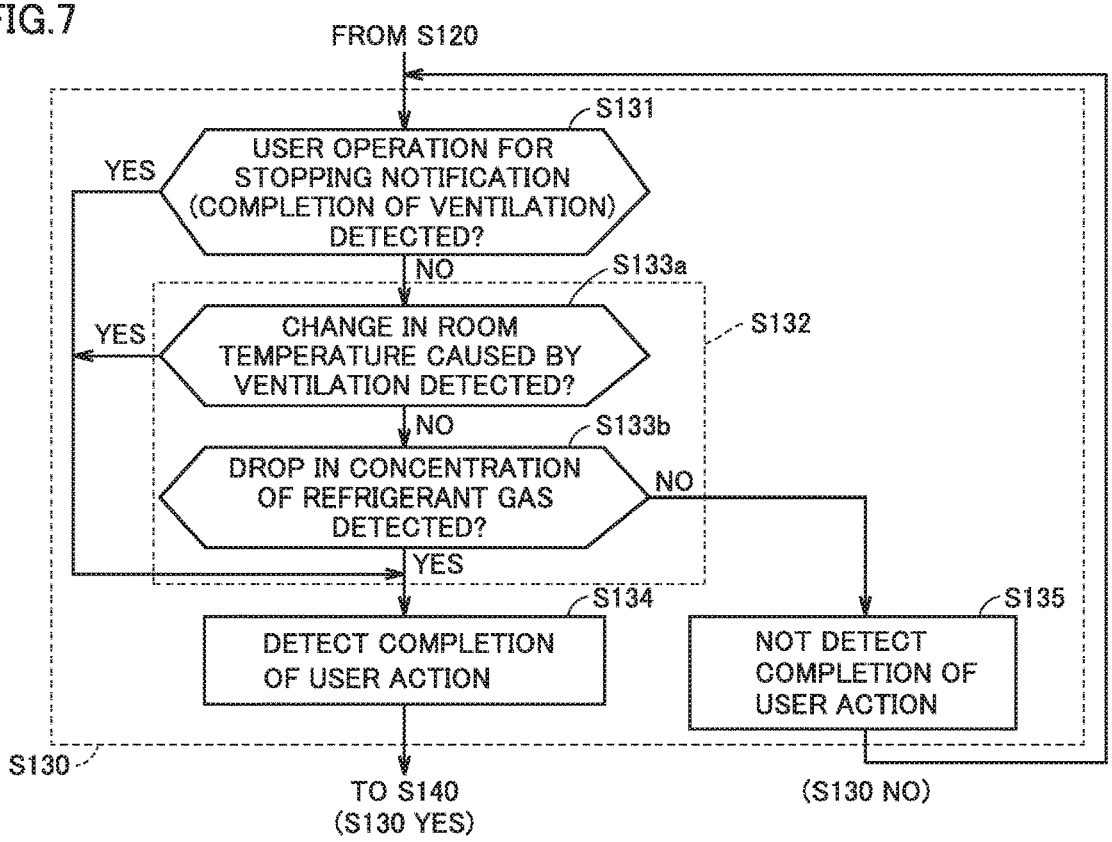
FIG. 7 is a flowchart explaining a first example of the process for detecting the completion of the user action shown in FIG. 6.

FIG. 7 shows a flowchart explaining a first example of the process for detecting the completion of the user action at step S130 in FIG. 6.

With reference to FIG. 7, control device 200 executes the processes of steps S131 to S135 to detect the completion of the user action.

At step S131, control device 200 determines whether or not the user operation that instructs the stop of notification is detected. For example, the determination at step S131 is executed based on the presence or absence of operation on the above-described specific switch.

By step S132, control device 200 determines whether or not ventilation has been executed, based on the change in temperature and/or the concentration of refrigerant gas. Step S132 includes step S133*a* and S133*b*.

At step S133*a*, control device 200 determines whether or not a change in room temperature caused by ventilation has been detected. For example, the determination at step S133*a* can be executed based on the detection values from room temperature sensor 5 and outside air temperature sensor 6. Specifically, if (room temperature)>(outside air temperature) is satisfied, a change in room temperature caused by ventilation can be detected when the room temperature has dropped by equal to or more than a prescribed temperature from the temperature at the time of notification by step S120. On the other hand, if (room temperature)<(outside air temperature) is satisfied, a change in room temperature caused by ventilation can be detected when the room temperature has risen by equal to or more than a prescribed temperature from the temperature at the time of notification by step S120.

At step S133*b*, control device 200 determines whether or not a drop in concentration of refrigerant gas has been detected. For example, at step S133*b*, a drop in concentration of refrigerant gas is detected when the concentration of refrigerant gas detected by refrigerant leakage sensor 4 is equal to or less than a prescribed value.

Thus, by the process of step S132, the function of the "ventilation determination unit" can be performed. Step S132 can be performed by only one of step S133*a* and S133*b*.

When at least any of steps S131, S133*a*, and S133*b* is determined to be YES, control device 200 advances the process to step S134, where the completion of the user action (ventilation) is detected. Accordingly, step S130 is determined to be YES, and the process is advanced to step S140 (FIG. 6).

On the other hand, when all of steps S131, S133*a*, and S133*b* are determined to be NO, the process is advanced to step S135, where the completion of the user action is not detected. Accordingly, step S130 is determined to be NO, and control device 200 executes the determination by step S130 again after a lapse of prescribed time equivalent to the control period.

According to the example in FIG. 7, if the detection of leakage of refrigerant is a false detection, the user can stop the notification by inputting an instruction for stopping the notification (S131) without calling a maintenance administrator or serviceman. The information that prompts ventilation is stopped when the completion of ventilation is detected based on the change in room temperature (S132) and the drop in concentration of refrigerant gas (S133) caused by ventilation. This avoids a situation in which the notification of information still continues when the user has already executed ventilation. Therefore, the user's discomfort can be alleviated.

Further, since the notification of information that prompts ventilation continues until the user completes ventilation, the user can more reliably execute ventilation.

Thus, the concentration of leaked refrigerant can be reduced in a shorter time.

Referring back to FIG. 6, when control device 200 detects the completion of the user action (ventilation) (YES at S130), control device 200 advances the process to step S140, and stops notifying the information that prompts ventilation. From that point forward, the output of information to the user from at least any of display 221, speaker 222, and light-emitting portion 223 is stopped. At this time, whether to stop alarm 230 is optional. That is, alarm 230 can still remain activated after the output of information to the user is stopped. On the other hand, until the completion of the user action (ventilation) is detected (NO at S130), the notification of information that prompts ventilation continues without stopping.

Thus, according to the refrigeration cycle apparatus in embodiment 1, when a leakage of refrigerant is detected by refrigerant leakage sensor 4 in the space in which indoor unit 3 is disposed, the information that prompts ventilation in the space can be outputted to the user. The output of information continues until the completion of ventilation is detected. Upon proper completion of the user action (ventilation), the output of message is stopped. Thus, the user guidance can be appropriately performed so as to prevent problems associated with an increase in concentration of refrigerant gas that would be caused by a continuing leakage of refrigerant in a poorly ventilated room.

Figure 8:
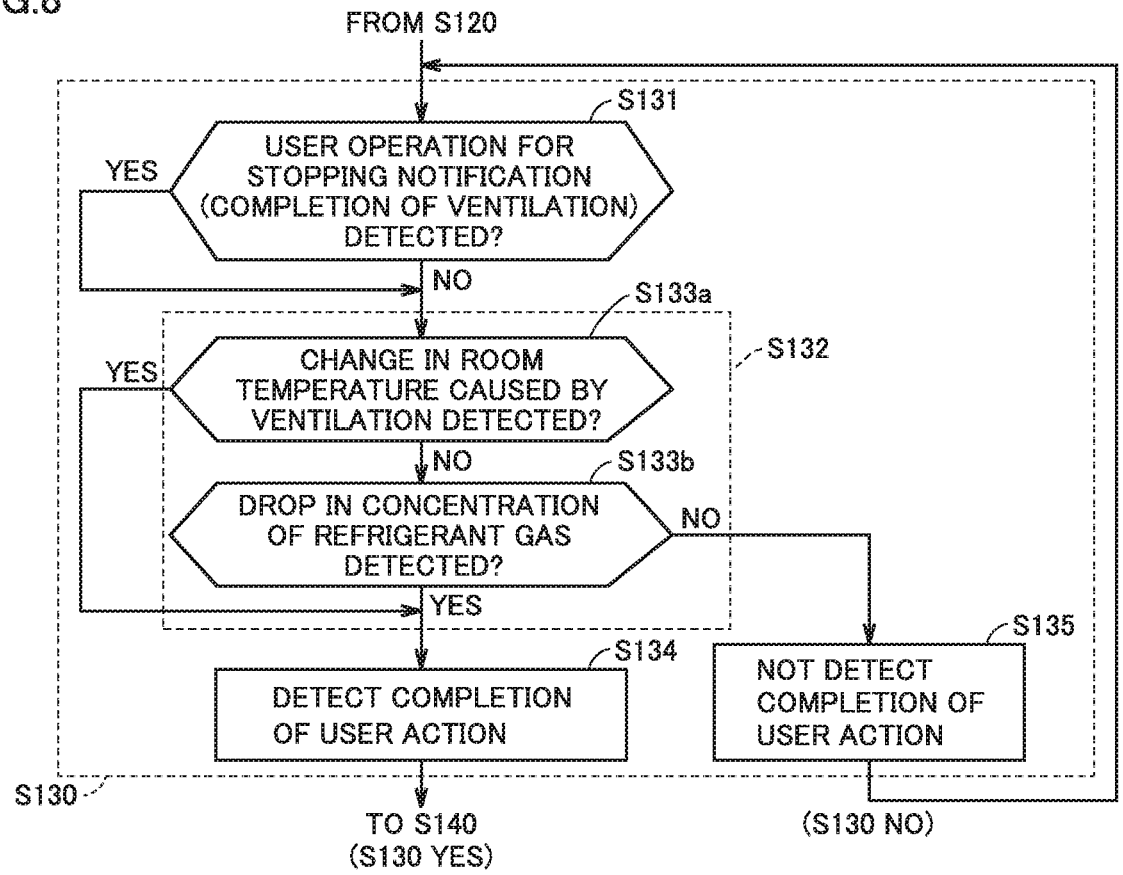
FIG. 8 is a flowchart explaining a second example of the process for detecting the completion of the user action shown in FIG. 6.
Figure 9:
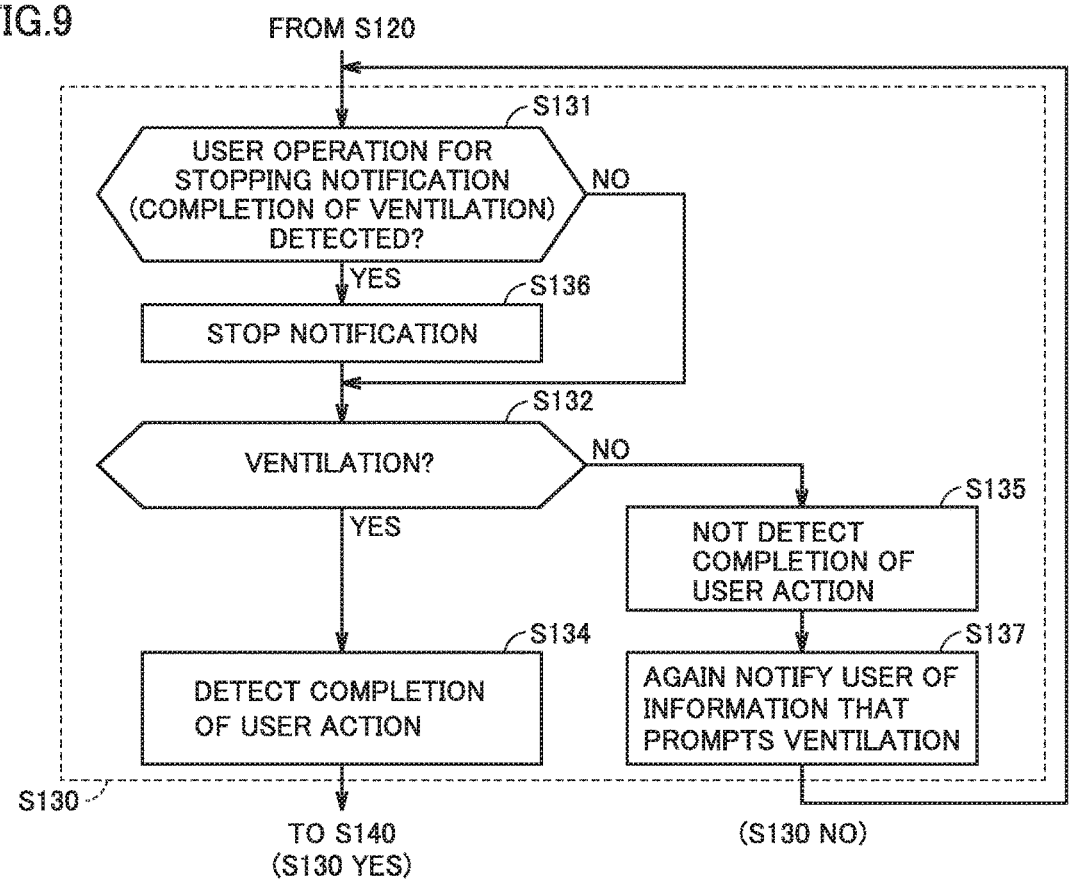
FIG. 9 is a flowchart explaining a third example of the process for detecting the completion of the user action shown in FIG. 6.
Figure 10:
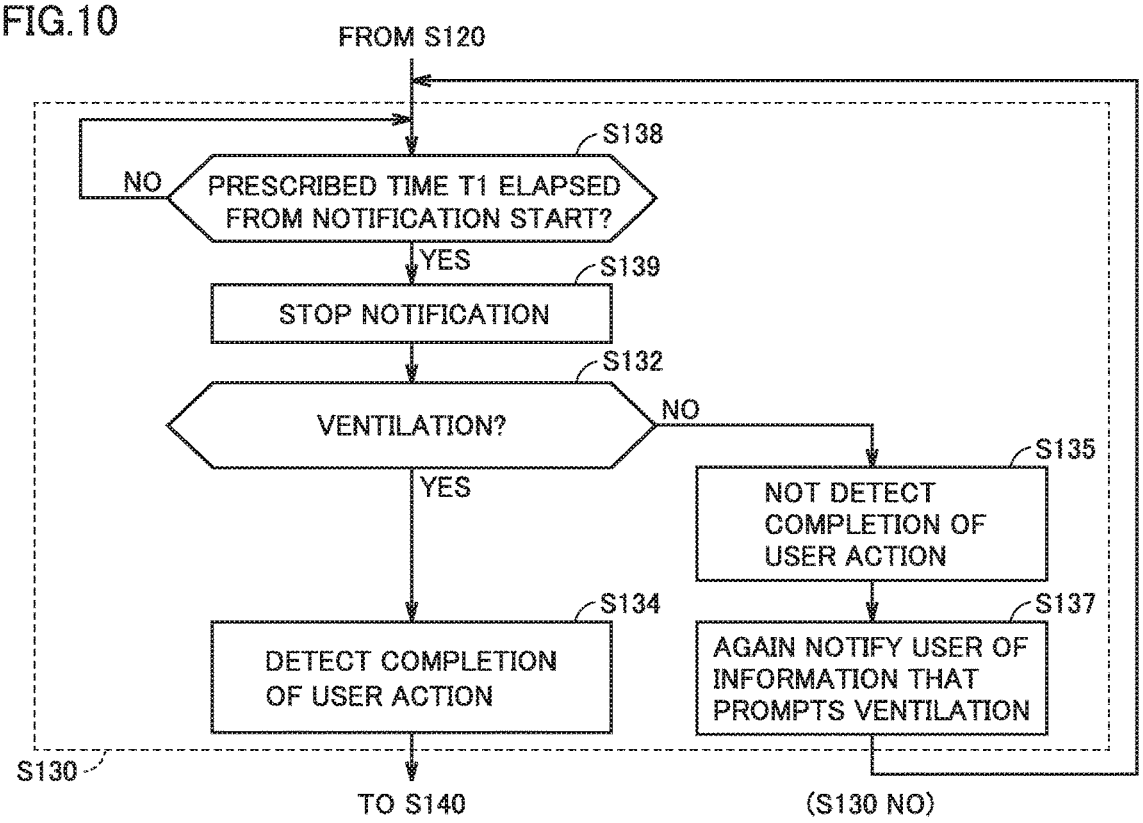
FIG. 10 is a flowchart explaining a fourth example of the process for detecting the completion of the user action shown in FIG. 6.

Alternatively, the process for detecting the completion of the user action at step S130 in FIG. 6 can be modified as shown in FIG. 8 to FIG. 10.

FIG. 8 shows a flowchart explaining a second example of the process for detecting the completion of the user action.

With reference to FIG. 8, in the second example, step S130 for detecting the completion of the user action performs a process different from that of FIG. 7 when step S131 detects the user operation that instructs the stop of notification (YES at step S131).

Specifically, when step S131 is determine to be YES, control device 200 advances the process to step S132, rather than to step S134. Therefore, when control device 200 detects the user operation that instructs the stop of notification, control device 200 determines, by step S132, whether or not ventilation has completed, based on the change in temperature and/or the concentration of refrigerant gas. The control process of the other steps in FIG. 8 is identical to that of FIG. 7, including the determination by step S132. Thus, the detailed description is not repeated.

According to the second example shown in FIG. 8, the determination of completion of ventilation depends not only on the user's action completion operation. Therefore, the completion of ventilation can be more accurately determined. This can prevent the information that prompts ventilation from being improperly stopped by the user's error in operation.

FIG. 9 shows a flowchart explaining a third example of the process for detecting the completion of ventilation.

With reference to FIG. 9, in the third example, step S130 for detecting the completion of ventilation includes steps S136 and S137, in addition to steps S131 to S135 identical to those of FIG. 7.

When the user operation that instructs the stop of notification is detected (YES at S131), control device 200 stops notifying the information that prompts ventilation (S120) by step S136. After the stop of notification, control device 200 determines, by step S132 identical to that of FIG. 7, whether or not ventilation has been executed, based on the change in temperature and/or the concentration of refrigerant gas.

When the execution of ventilation is detected (YES at S132), control device 200 advances the process to step S134 and detects the completion of the user action. Accordingly, the notification of information that prompts ventilation is stopped by step S140 (FIG. 6).

On the other hand, when the execution of ventilation is not detected (NO at S132), control device 200 does not detect the completion of the user action at step S135, and advances the process to step S137 to notify the user of the information that prompts ventilation. Accordingly, the information that prompts ventilation, which was stopped at step S136, is notified again to the user.

In this case, at step S137, a message different from that of step S120 (e.g., "the window has not been opened yet") can be provided to prompt ventilation. Alternatively, a message identical to that of step S120 can be outputted again.

When the user operation that instructs the stop of notification is not detected (NO at S131), control device 200 skips step S136 and advances the process to step S132. In this case, when the execution of ventilation is not detected (NO at S132), step S137 can continue notifying the information that prompts ventilation, which was started by step S120. Accordingly, step S130 is determined to be NO, and the process is again returned to step S131.

According to the third example shown in FIG. 9, as with the second example, the determination of completion of ventilation depends not only on the user's action completion operation. Therefore, the completion of ventilation can be more accurately determined. Further, the user corresponding to indoor unit 3 can be more strongly prompted to ventilate when ventilation has not actually completed, since the notification of information is stopped in response to the user operation.

FIG. 10 shows a flowchart explaining a fourth example of the process for detecting the completion of ventilation.

With reference to FIG. 10, in the fourth example, control device 200 determines, by step S138, whether or not prescribed time T1 has elapsed from the start of notification by step S120. When prescribed time T1 has elapsed (YES at S138), control device 200 automatically stops notifying the information that prompts ventilation (S120) by step S139. Until prescribed time T1 has elapsed (NO at S138), the notification of information that prompts ventilation (S120) continues, without execution of step S139.

After the stop of notification by step S139, control device 200 executes steps S132, S134, S135, S137 identical to those of FIG. 9. Thus, when the execution of ventilation is detected based on the change in temperature and/or the concentration of refrigerant gas (YES at S132), the completion of the user action is detected by step S134. Accordingly, step S130 is determined to be YES.

When the execution of ventilation is not detected after the notification was stopped (NO at S132), control device 200 does not detect the completion of the user action (S135) and executes step S137 identical to that of FIG. 9. Further, step S130 is determined to be NO, and the process is returned to step S138.

According to the fourth example shown in FIG. 10, after a lapse of prescribed time T1 (S138), the notification of information that prompts ventilation is automatically stopped. At this point of time, if it is determined, based on the change in temperature and/or the concentration of refrigerant gas, that ventilation has not been executed, the information that prompts ventilation can be notified to the user again. Thus, when there is an error in notification due to a noise in detection value from refrigerant leakage sensor 4 for example, the notification can be automatically stopped. Further, when the concentration of refrigerant gas has actually risen, the user can be prompted to ventilate every prescribed time T1. This can improve user convenience and provide appropriate guidance.

The control processes in FIG. 9 and FIG. 10 can be combined with the control process in FIG. 8, as appropriate. For example, after the notification to the user is stopped by step S136 or S139, the processes of steps S131 to S135 in FIG. 7 can be performed to detect whether or not ventilation has completed.

Also, the control processes in FIG. 9 and FIG. 10 can be combined. For example, in the control process in FIG. 10, the control process in FIG. 9 can be executed when the user operation is detected (YES at S131) before prescribed time T1 elapses (NO at S138). Further, the combination of the control processes in FIG. 9 and FIG. 10 can be further combined with the control process in FIG. 8.

(Refrigerant Recovery Operation)

When a leakage of refrigerant is detected by refrigerant leakage sensor 4, refrigeration cycle apparatus 1*a* in embodiment 1 preferably performs a refrigerant recovery operation on the outdoor unit 2 side, in addition to notifying the user of the information that prompts ventilation on the indoor unit 3 side. In particular, the refrigerant recovery operation is preferably performed in a multi air conditioning system in which a plurality of indoor units 3 are connected to one outdoor unit 2. That is because such a multi air conditioning system has a large amount of refrigerant flowing in the circulation pathway, and thus, when a leakage of refrigerant occurs, the amount of leakage of refrigerant should be reduced.

Further, upon completion of the pump down operation in response to the detection of leakage of refrigerant, a corresponding refrigerant pathway for outdoor unit 2 is shut off. Thus, the function of the above-described refrigerant shut-off device as safety measure device 400 can be performed.

Figure 11:
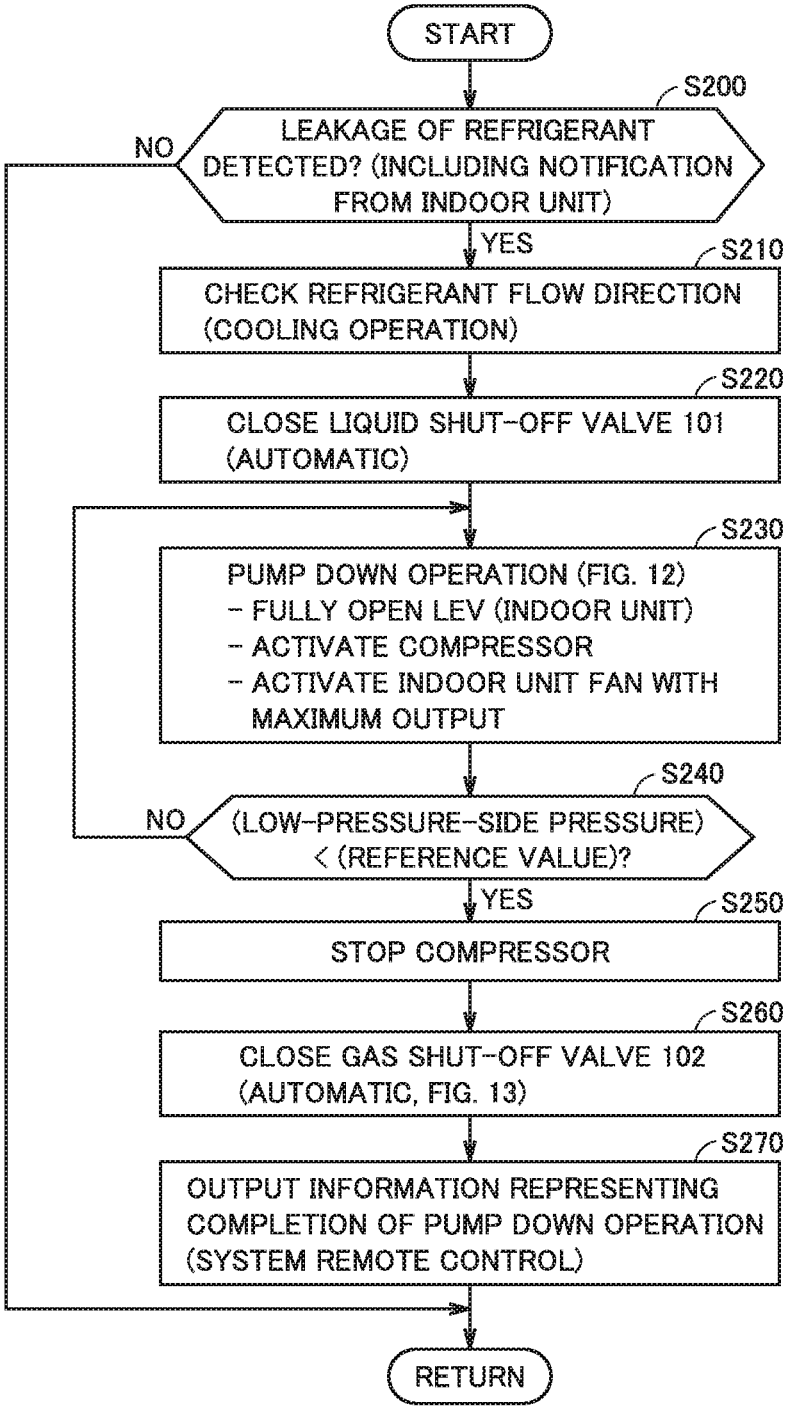
FIG. 11 is a flowchart for explaining a control process of the refrigerant recovery operation in the refrigeration cycle apparatus according to embodiment 1.

FIG. 11 is a flowchart for explaining a control process of the refrigerant recovery operation in the refrigeration cycle apparatus in embodiment 1. The control process shown in FIG. 11 can be executed by control device 300 of outdoor unit 2.

With reference to FIG. 11, when a leakage of refrigerant is detected (YES at S200), control device 300 starts the control processes at and after step S210. For example, step S200 is determined to be YES when the detection of leakage of refrigerant is notified from control device 200 of indoor unit 3. Alternatively, step S200 may be determined to be YES based on the detection value from a refrigerant leakage sensor (not shown) provided on the outdoor unit side.

When a leakage of refrigerant is not detected (NO at S200), control device 300 does not start the processes at and after step S210. That is, control device 300 can execute the control process shown in FIG. 11 by starting the control process in response to detection of a leakage of refrigerant.

By step S210, control device 300 checks the refrigerant flow direction in refrigeration cycle apparatus 1*a*, based on the state of four-way valve 100, so as to determine whether or not refrigeration cycle apparatus 1*a* is in the cooling operation state. If four-way valve 100 is in state 2 (heating operation state), control device 300 controls four-way valve 100 into state 1 (cooling operation state).

After that, control device 300 outputs a control signal to close shut-off valve 101 (liquid shut-off valve) by step S220. Further, control device 300 executes the pump down operation by activating compressor 10 by step S230.

Figure 12:
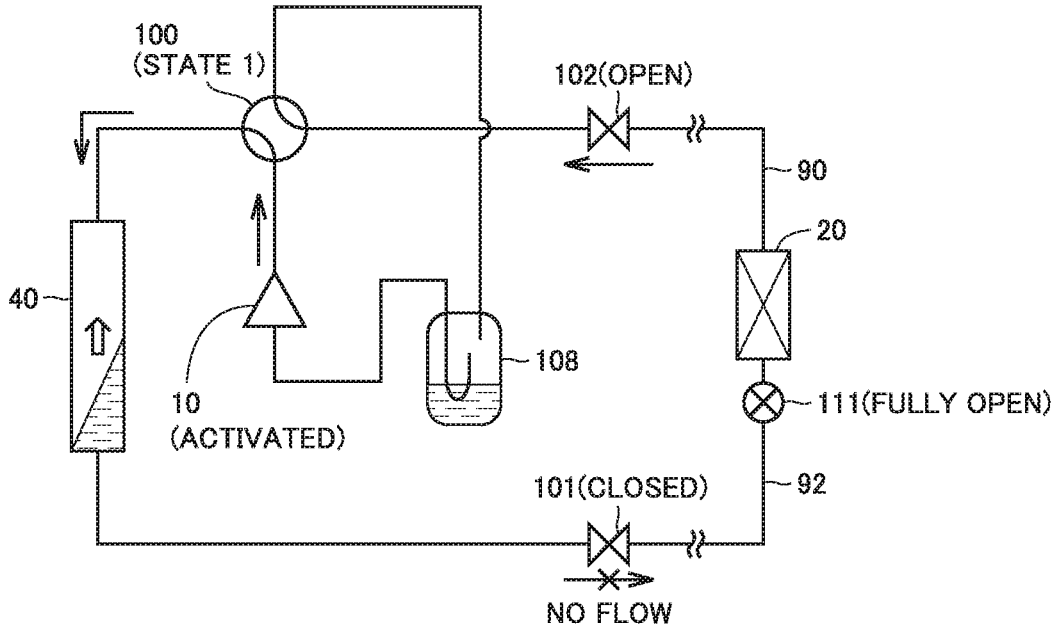
FIG. 12 is a schematic diagram for showing a refrigerant flow direction in the refrigeration cycle apparatus in the pump down operation.

FIG. 12 shows a schematic diagram for showing the refrigerant flow direction in the refrigeration cycle apparatus in the pump down operation.

With reference to FIG. 12, four-way valve 100 is controlled into state 1 (cooling operation state), where compressor 10 is activated while shut-off valve 101 (liquid shut-off valve) is closed and shut-off valve 102 (gas shut-off valve) is open. Thus, the refrigerant (vapor) in indoor heat exchanger 20 and extension pipes 90, 92 flows through open shut-off valve 102 and through accumulator 108 and is then taken in compressor 10. The refrigerant discharged from compressor 10 in a high-temperature, high-pressure state is sent to outdoor heat exchanger 40 and is then condensed.

Since shut-off valve 101 is closed, the condensed refrigerant accumulates in outdoor heat exchanger 40 in a liquid state. Such a pump down operation can recover the refrigerant in outdoor unit 2. The recovery of refrigerant reduces the pressure on the low-pressure side relative to compressor 10 (the detection value from pressure sensor 104 in FIG. 1), toward the atmospheric pressure.

In order to increase the amount of refrigerant to be recovered by the pump down operation, indoor heat exchanger 20 preferably promotes vaporization. Accordingly, at step S230, it is preferable that LEV 111 be fully open and indoor unit fan 31 be activated with maximum output.

Referring back to FIG. 11, during execution of the pump down operation (S230), control device 300 determines, by step S240, whether or not the low-pressure-side pressure detected by pressure sensor 104 has dropped below a predetermined reference value. Until the low-pressure-side pressure drops below the reference value (NO at S240), control device 300 continues the pump down operation.

On the other hand, when the pressure on the low-pressure side relative to compressor 10 has dropped below the reference value (YES at S240), control device 300 advances the process to step S250 and stops compressor 10. Further, control device 300 closes shut-off valve 102 by step S260.

Figure 13:
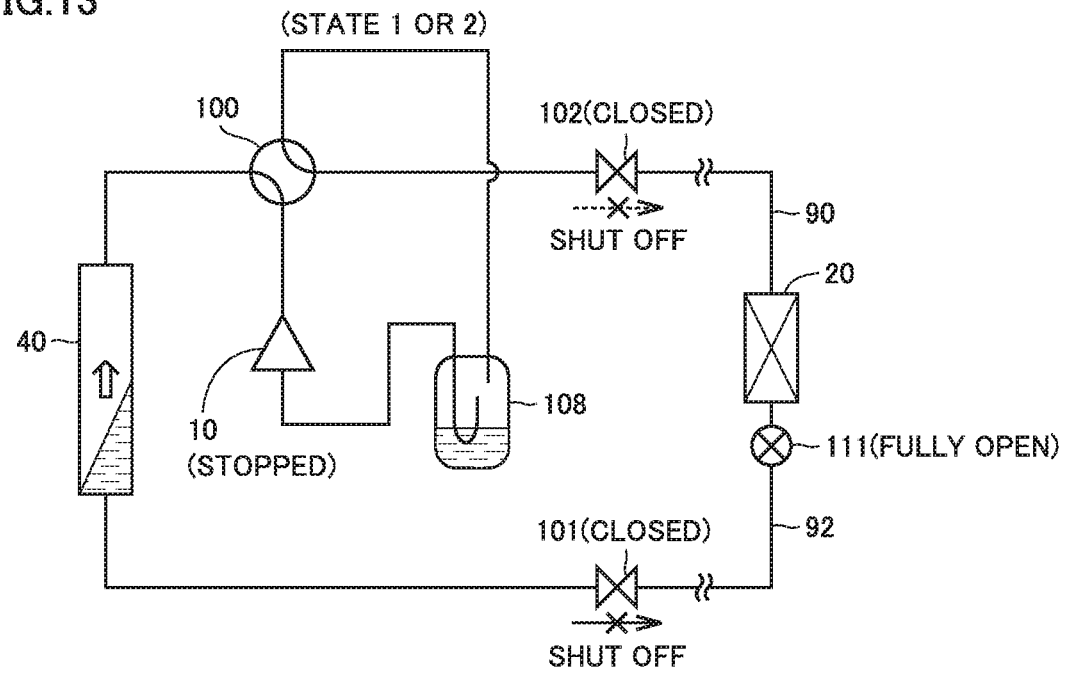
FIG. 13 is a schematic diagram for explaining the state of the refrigeration cycle apparatus at the end of the pump down operation.

FIG. 13 shows a schematic diagram for explaining the state of the refrigeration cycle apparatus at the end of the pump down operation.

With reference to FIG. 13, when the refrigerant is recovered in outdoor unit 2 and the pump down operation ends, shut-off valve 102 is closed, like shut-off valve 101. This can shut off the pathway through which the refrigerant recovered in outdoor unit 2 would otherwise flow backward into indoor unit 3. At this time, whether in state 1 (cooling operation state) or in state 2 (heating operation state), four-way valve 100 can shut off the refrigerant pathway from outdoor unit 2 to indoor unit 3.

This can function as the refrigerant shut-off device for shutting off supply of refrigerant to the space (rooms A, B) in which indoor unit 3 is disposed, as in the case of closing shut-off valves 430, 435 shown in FIG. 4. In other words, with no shut-off valves 430, 435 (FIG. 4), the refrigerant shut-off device that serves as safety measure device 400 can be achieved by the combination of the pump down operation and the shut-off mechanism on the refrigerant pathway on the outdoor unit 2 side.

Further, by step S270, control device 200 outputs the information representing the completion of the pump down operation, using system remote control 310. For example, control device 200 can notify the user corresponding to outdoor unit 2 (including a maintenance administrator or serviceman, for example) that the pump down operation has completed, as visual information and/or aural information, using information output device 320 of system remote control 310.

Thus, in the refrigeration cycle apparatus in embodiment 1, when a leakage of refrigerant is detected by refrigerant leakage sensor 4, the user can be prompted to ventilate the space in which indoor unit 3 is disposed. Also, on the outdoor unit 2 side, the pump down operation can recover the refrigerant, and thus prevent continuing leakage of refrigerant. Further, the automatic closing of gas-side shut-off valve 102 at the end of the pump down operation can serve as a refrigerant shut-off device for safety measure device 400.

In a refrigeration cycle apparatus in embodiment 1 with no shut-off valve 102, a refrigerant shut-off device can be similarly provided.

Figure 14:
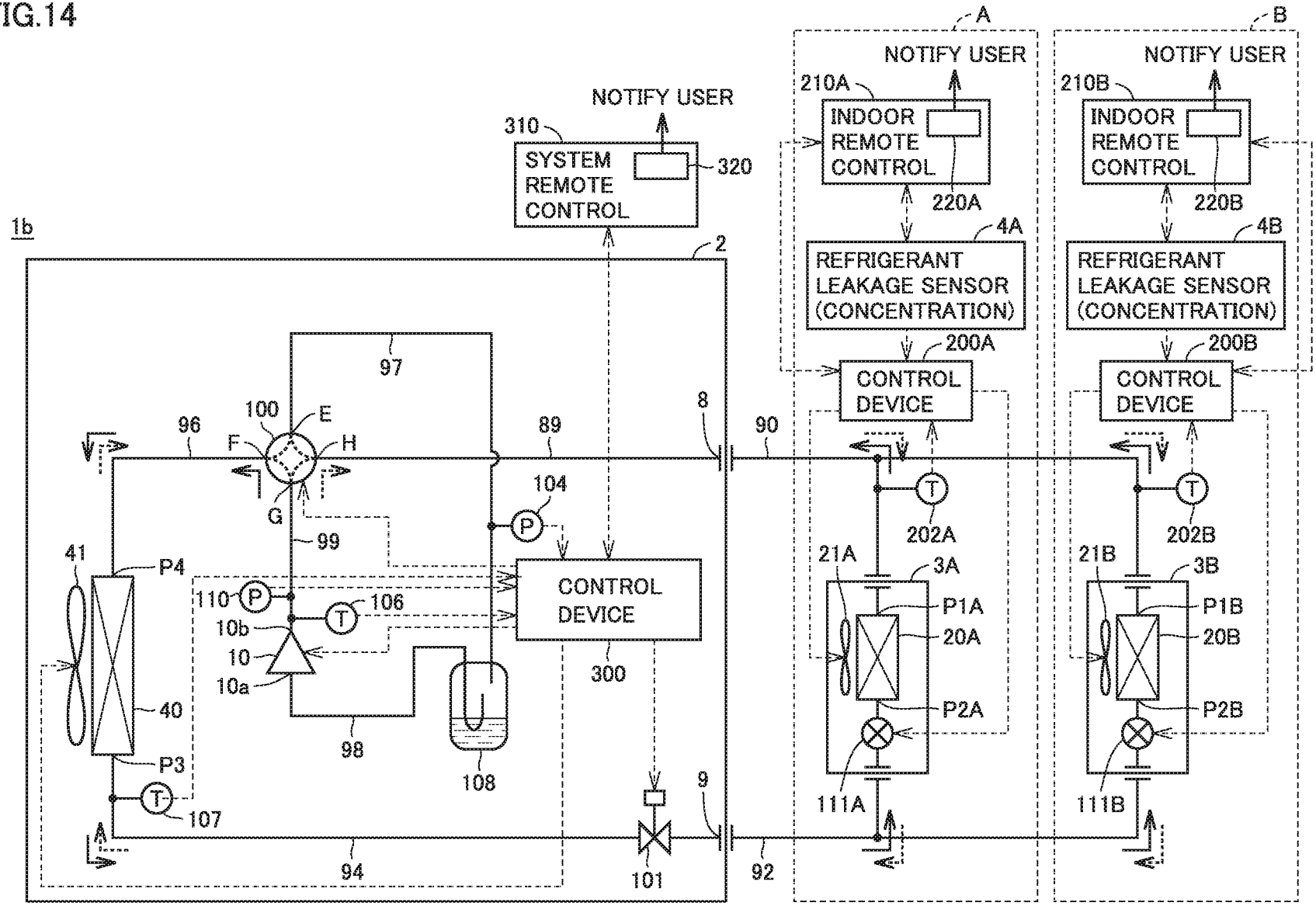
FIG. 14 is a block diagram explaining a configuration of a refrigeration cycle apparatus, which is the same as that of embodiment 1 but without a gas-side shut-off valve.

FIG. 14 is a block diagram explaining a configuration of a refrigeration cycle apparatus 1*b*, which is the same as that of embodiment 1 but without a gas-side shut-off valve.

FIG. 14 being compared with FIG. 1, refrigeration cycle apparatus 1*b* is different from refrigeration cycle apparatus 1*a* (FIG. 1) in that the former does not have shut-off valve 102. The configuration of the other parts of refrigeration cycle apparatus 1*b* is identical to that of refrigeration cycle apparatus 1*a* (FIG. 1), and thus the detailed description is not repeated. Refrigeration cycle apparatus 1*b* is identical to refrigeration cycle apparatus 1*a* in embodiment 1 in all respects (including the user guidance outputted when a leakage of refrigerant is detected by refrigerant leakage sensor 4), except for the control process of the pump down operation.

Figure 15:
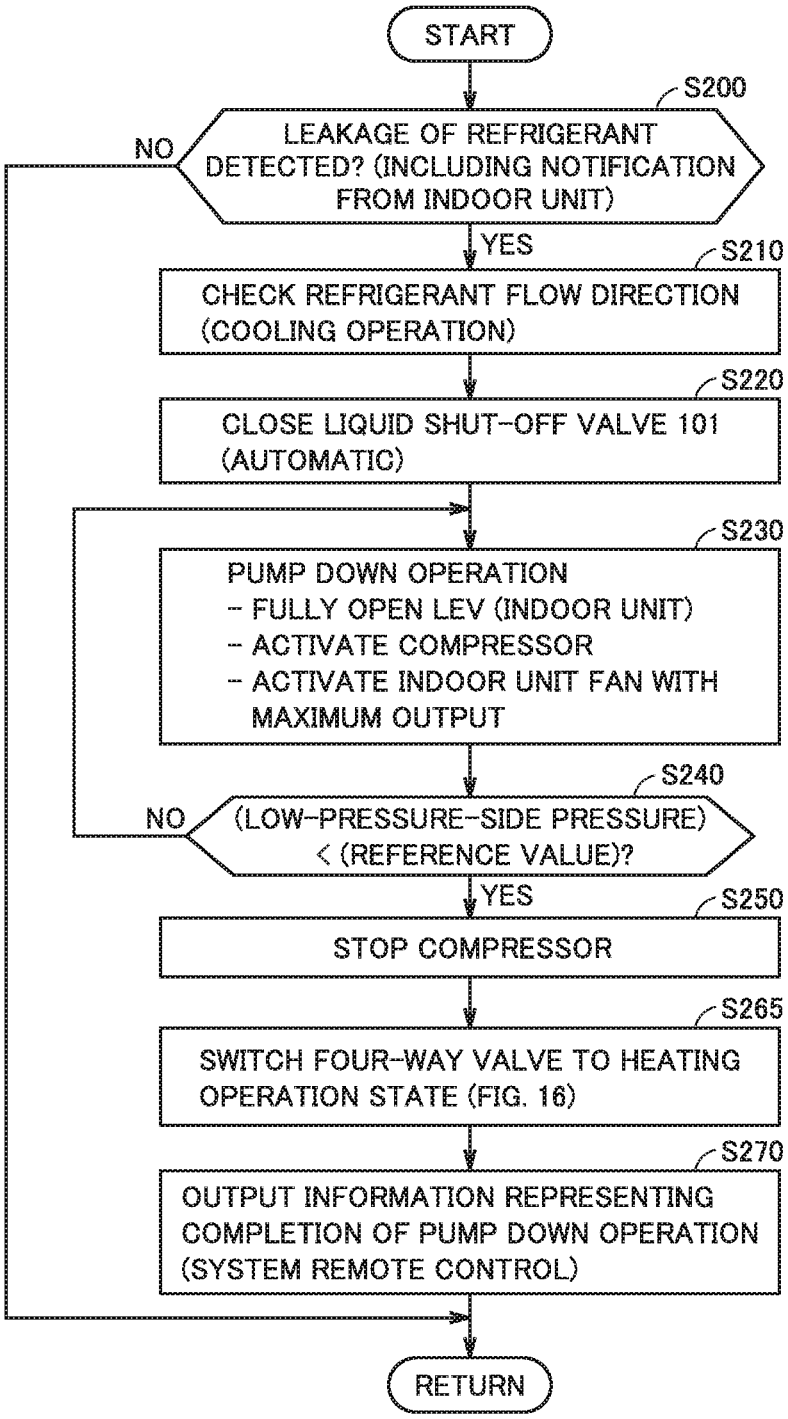
FIG. 15 is a flowchart for explaining a control process of the refrigerant recovery operation in the refrigeration cycle apparatus shown in FIG. 14.

FIG. 15 is a flowchart for explaining a control process of the refrigerant recovery operation in refrigeration cycle apparatus 1*b*.

With reference to FIG. 15, the processes of steps S200 to S250 and S270 in the refrigerant recovery operation in refrigeration cycle apparatus 1*b* are identical to those of FIG. 11, and thus the description is not repeated. It is understood that, since refrigeration cycle apparatus 1*b* does not have shut-off valve 102, the refrigerant recovery pathway formed in the pump down operation (S230) is equivalent to that of FIG. 12.

In refrigeration cycle apparatus 1*b*, at the end of the pump down operation, control device 300 stops compressor 10 (S250) and then executes step S265. At step S265, control device 300 generates a control signal for switching four-way valve 100 from state 1 (cooling operation state) to the heating operation state (state 2).

Figure 16:
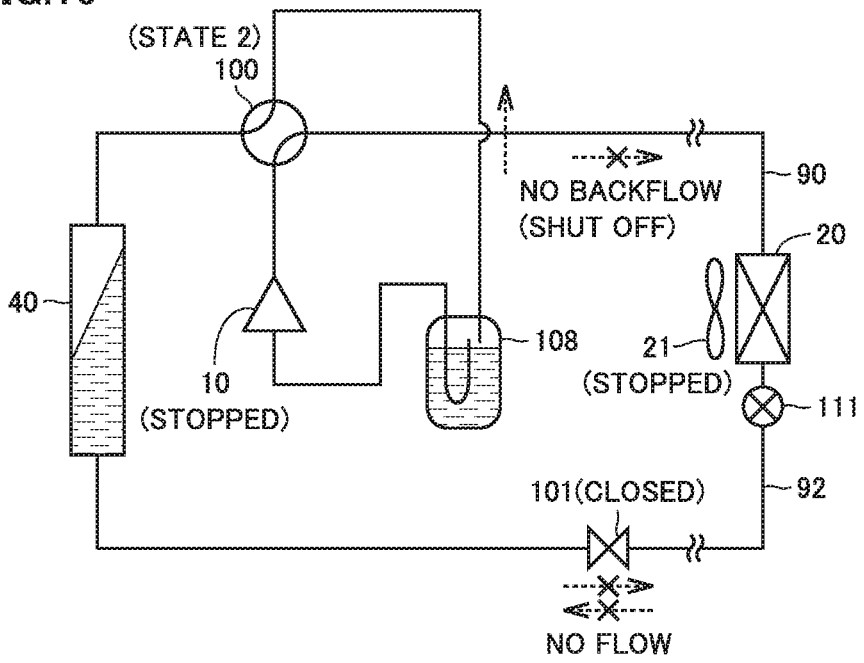
FIG. 16 is a schematic diagram for explaining the state of the refrigeration cycle apparatus shown in FIG. 14 at the end of the pump down operation.

FIG. 16 is a schematic diagram for explaining the state of refrigeration cycle apparatus 1*b* at the end of the pump down operation.

With reference to FIG. 16, when four-way valve 100 is controlled into state 2 (heating operation state), accumulator 108 is connected to outdoor heat exchanger 40. Thus, the refrigerant pathway between accumulator 108 and indoor unit 3 is shut off.

That is, controlling four-way valve 100 into state 2 (heating operation state) can shut off the refrigerant pathway between accumulator 108 and indoor unit 3 upon completion of the refrigerant recovery operation. In this state, accumulator 108 is connected to indoor unit 3 via stopped compressor 10. Thus, the refrigerant accumulated in accumulator 108 can be prevented from flowing backward into indoor unit 3.

Thus, as with refrigeration cycle apparatus 1*a* in embodiment 1, refrigeration cycle apparatus 1*b* with no gas shut-off valve 102 can still recover the refrigerant on the outdoor unit 2 side by the pump down operation. Also, controlling four-way valve 100 into state 2 (heating operation state) at the end of the pump down operation can serve as a refrigerant shut-off device for safety measure device 400.

Variation 1 of Embodiment 1

Next, a variation of the information outputted as the user guidance is explained, as variation 1 of embodiment 1.

Figure 17:
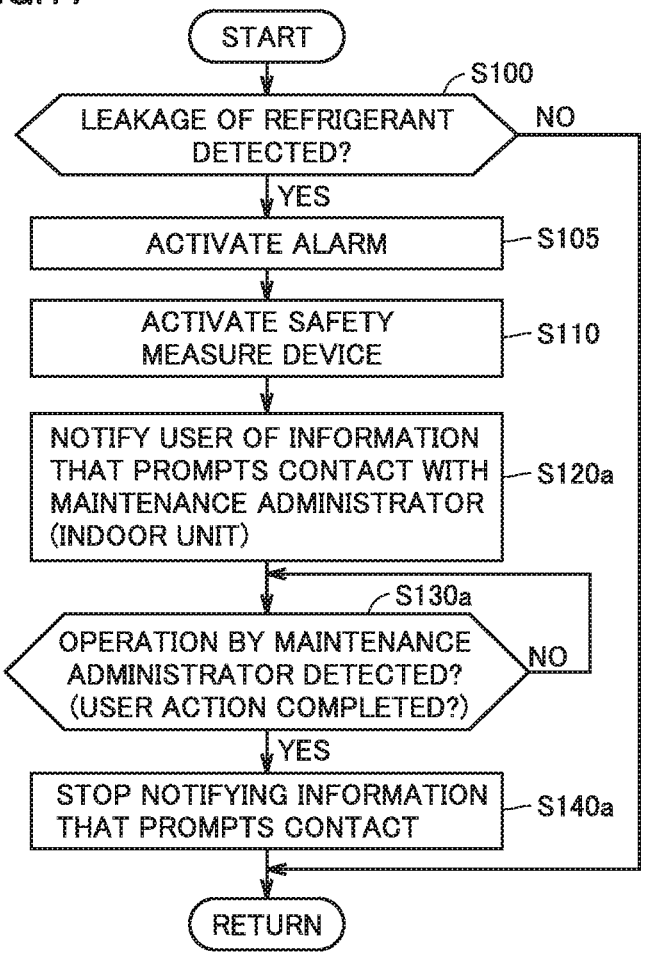
FIG. 17 is a flowchart explaining a control process of when a leakage of refrigerant is detected, according to variation 1 of embodiment 1.

FIG. 17 is a flowchart explaining a control process of when a leakage of refrigerant is detected, according to variation 1 of embodiment 1.

With reference to FIG. 17, by steps S100 to S110 identical to those of FIG. 6, when a leakage of refrigerant is detected (YES at S100), control device 200 activates alarm 230 (S105) and safety measure device 400 (S110). Also, by step S120*a*, control device 200 outputs information that prompts a contact with the maintenance administrator so as to let the maintenance administrator know that a leakage of refrigerant has occurred. As with the information that prompts ventilation, the information is notified to the user corresponding to indoor unit 3, using information output device 220 corresponding to indoor remote control 210.

This information can be outputted by speaker 222 as a voice message (aural information), such as "contact the maintenance administrator". Alternatively, a message that prompts a contact with the maintenance administrator can be outputted by display 221 as visual information. The information that prompts a contact with the maintenance administrator notified to the user at step S120*a* corresponds to the "guidance information", and particularly corresponds to one example of the "second information". Note that, after step S100, step S120*a* may be executed simultaneously with steps S105, S110, or may be executed after steps S105, S110.

For the maintenance administrator, an operation switch is provided. When the maintenance administrator receives contact from the user corresponding to indoor unit 3 and is notified of the occurrence of leakage of refrigerant, the maintenance administrator operates this operation switch to acknowledge receipt of the contact. For example, the operation switch can be a specific switch among a plurality of operation switches 316 of system remote control 310. Alternatively, the operation switch (not shown) can be located at a place different from system remote control 310 (e.g., in a centralized control room in the building). The operation switch corresponds to one example of the "second operation unit".

After the information that prompts a contact is notified by step S120*a*, control device 200 determines, by step S130*a*, whether or not the input to the operation switch has been detected. When control device 200 detects the input to the operation switch (YES at S130*a*), control device 200 advances the process to step S140*a*, and stops notifying the information that prompts a contact with the maintenance administrator. At step S140*a*, whether to stop alarm 230 is optional. That is, alarm 230 can still remain activated after the output of information to the user is stopped.

On the other hand, until the input to the operation switch is detected (NO at S130*a*), the notification of information that prompts a contact with the maintenance administrator continues without stopping. When step S130*a* is determined to be NO, control device 200 executes the determination by step S130*a* again after a lapse of prescribed time equivalent to the control period.

Thus, according to variation 1 of embodiment 1, when a leakage of refrigerant is detected in the space in which indoor unit 3 is disposed, the user corresponding to indoor unit 3 can contact with the maintenance administrator without fail. When receiving the contact, the maintenance administrator can acknowledge receipt of the contact for the user corresponding to indoor unit 3 by stopping outputting the guidance information.

By combination with embodiment 1, both of the "information that prompts ventilation" and the "information that prompts a contact with the maintenance administrator" can be outputted as the guidance information. In this case, step S130 (FIG. 6) and step S130*a* (FIG. 18) are independently executed for determining whether to stop outputting each guidance information.

Variation 2 of Embodiment 1

If a combustible refrigerant is used, banning on the use of fire is important for safety. Variation 2 of embodiment 1 describes the control of when a leakage of refrigerant is detected in such a case.

Figure 18:
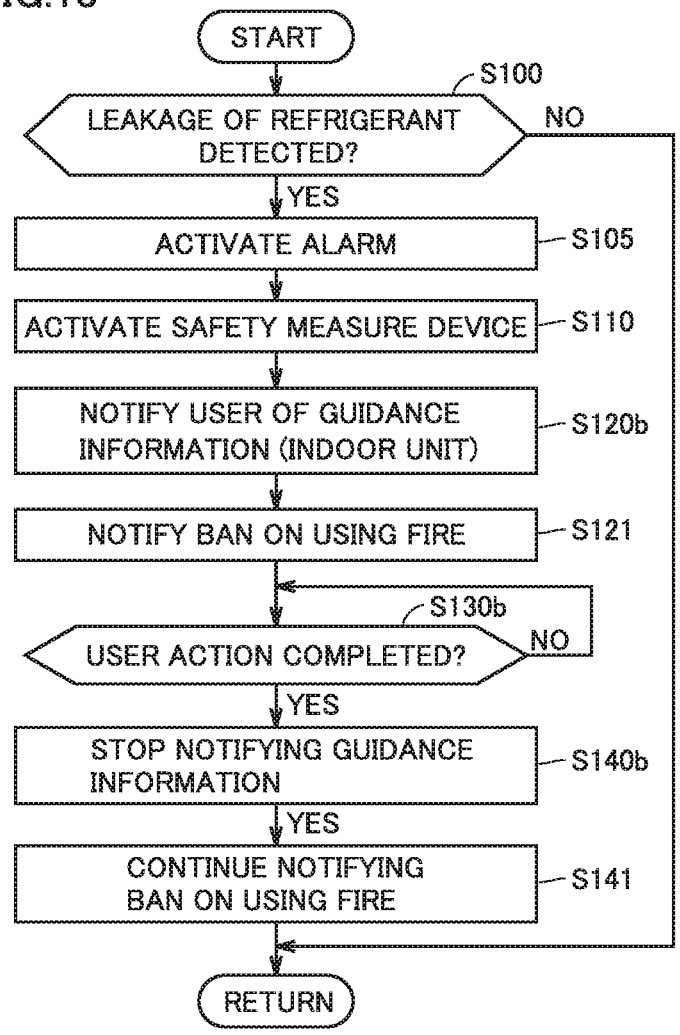
FIG. 18 is a flowchart explaining a control process of when a leakage of refrigerant is detected, according to variation 2 of embodiment 1.

FIG. 18 is a flowchart explaining a control process of when a leakage of refrigerant is detected, according to variation 2 of embodiment 1.

With reference to FIG. 18, by steps S100 to S110 identical to those of FIG. 6, when a leakage of refrigerant is detected (YES at S100), control device 200 activates alarm 230 (S105) and safety measure device 400 (S110). Also, by step S120*b*, control device 200 outputs the guidance information to the user corresponding to indoor unit 3.

At step S120*b*, one of or both of the "information that prompts ventilation" by step S120 (FIG. 6) and the "information that prompts a contact with the maintenance administrator" by step S120*a* (FIG. 17) is outputted.

Further, by step S121, control device 200 outputs information that notifies a ban on using fire. This information can be outputted as visual information and/or aural information, using information output device 220. The information that notifies a ban on using fire notified to the user corresponding to indoor unit 3 by step S121 corresponds to the "third information". The processes of steps S105, S110, S120*b*, S121 may be executed simultaneously or successively after step S100.

Regarding the output of the guidance information by step S120*b*, control device 200 determines, by step S130*b*, whether or not the user action in response to the guidance information has completed. At step S130*b*, in accordance with the content of the guidance information (S120*b*), one of or both of the determination by step S130 (FIG. 6) and the determination by step S130*a* (FIG. 17) is executed.

Until the completion of the user action is detected (NO at S130*b*), control device 200 continues outputting the guidance information (S120*b*). When step S130*b* is determined to be NO, the determination by step S130*b* is executed again after a lapse of prescribed time equivalent to the control period.

On the other hand, when control device 200 detects the completion of the user action (YES at S130*b*), control device 200 advances the process to step S140*b*, and stops outputting the guidance information (S120*b*). By step S141, control device 200 continues outputting the information that notifies a ban on using fire (S121).

Thus, according to variation 2 of embodiment 1, when a leakage of refrigerant is detected in the space in which indoor unit 3 is disposed, a ban on using fire can continue being notified to the user if the output of the guidance information (S120*b*) is stopped upon completion of the user action (ventilation and/or contact with the maintenance administrator). Therefore, if a combustible refrigerant is used, a ban on using fire can be strongly notified to the user.

The information that notifies a ban on using fire can be stopped upon the lapse of a prescribed period Tx, which is a relatively long period (e.g., Tx>>T1). If the guidance information is still being outputted with no detection of the completion of the user action when prescribed period Tx has elapsed, then the output of the guidance information can be stopped.

If the "information that prompts ventilation" is not necessary, such as in a space in which a ventilation device is activated all the time, only the "information that notifies a ban on using fire" may be outputted, but without the "information that prompts ventilation".

Embodiment 2

Embodiment 2 describes the control for further outputting the user guidance related to the pump down operation, with gas-side shut-off valve 102 being a manual valve.

Figure 19:
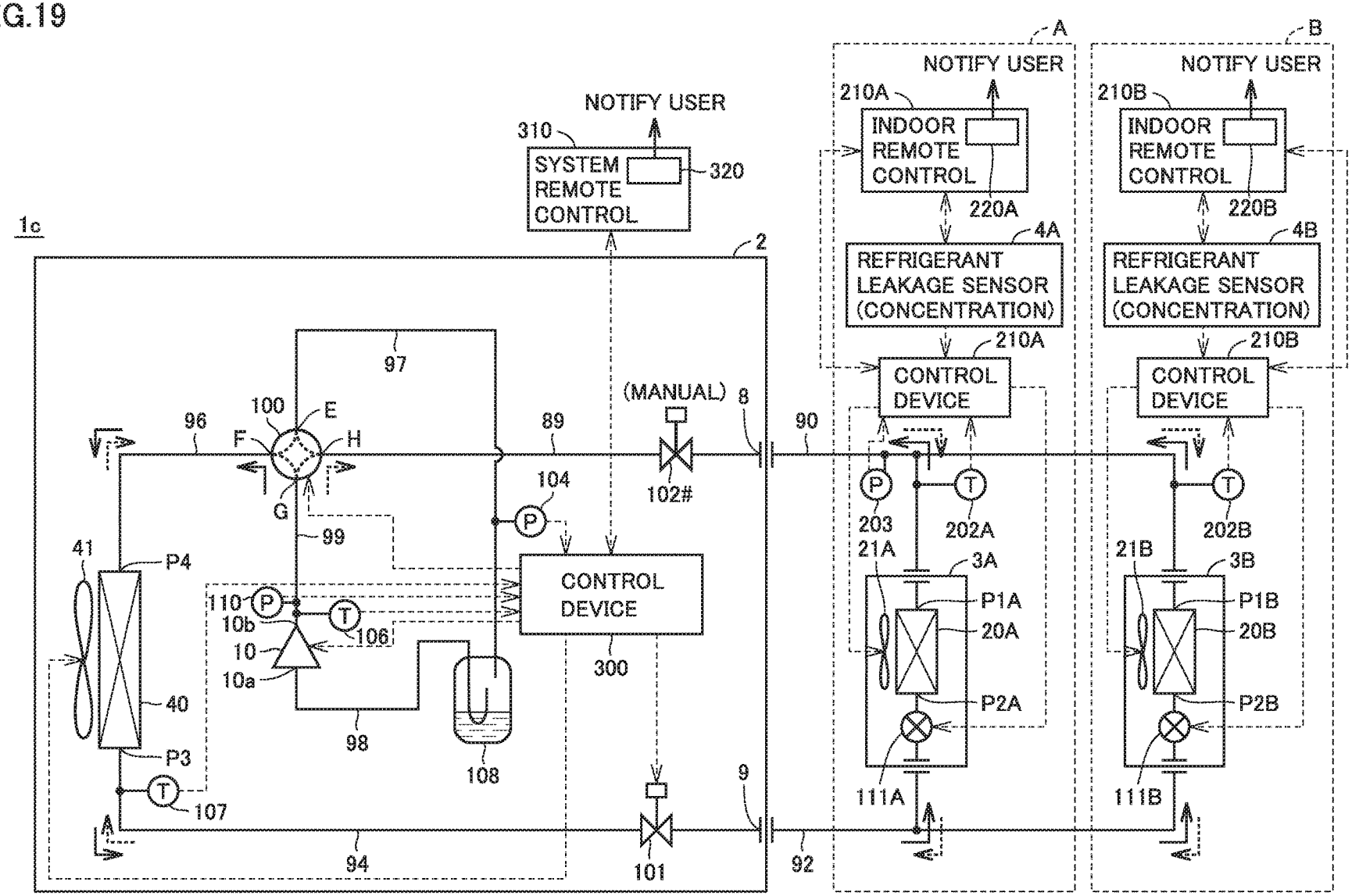
FIG. 19 is a block diagram explaining a configuration of a refrigeration cycle apparatus in embodiment 2.

FIG. 19 is a block diagram explaining a configuration of a refrigeration cycle apparatus in embodiment 2.

With reference to FIG. 19 in combination with FIG. 1, a refrigeration cycle apparatus 1*c* in embodiment 2 is different from refrigeration cycle apparatus 1*a* (FIG. 1) in that the former includes manual shut-off valve 102# that is opened and closed by the user, instead of automatic shut-off valve 102, as a gas shut-off valve. The configuration of the other parts of refrigeration cycle apparatus 1*c* is identical to that of refrigeration cycle apparatus 1*a* shown in FIG. 1, and thus the detailed description is not repeated.

The output of the user guidance described in embodiment 1 and its variations can also be applied to the case with a manual gas shut-off valve. Accordingly, in refrigeration cycle apparatus 1*c* in embodiment 2, when a leakage of refrigerant is detected by refrigerant leakage sensor 4 in the space in which indoor unit 3 is disposed, the guidance information identical to that of embodiment 1 and its variations can be outputted to the user corresponding to indoor unit 3, in accordance with FIG. 6 to FIG. 10, FIG. 17, and FIG. 18.

Manual shut-off valve 102# may be, for example, a ball valve. A manual valve, such as a ball valve, is typically lower than an electromagnetic valve in pressure loss at the gas shut-off valve during a normal operation. Therefore, the refrigeration cycle apparatus can be improved in capability and coefficient of performance (COP).

However, unlike the refrigerant recovery operation described with reference to FIG. 11 to FIG. 13 in embodiment 1, manual shut-off valve 102# cannot be automatically closed. Accordingly, in refrigeration cycle apparatus 1*c* in embodiment 2, the information that prompts a closing operation of shut-off valve 102# is notified to the user when the pump down operation (FIG. 12) completes.

Figure 20:
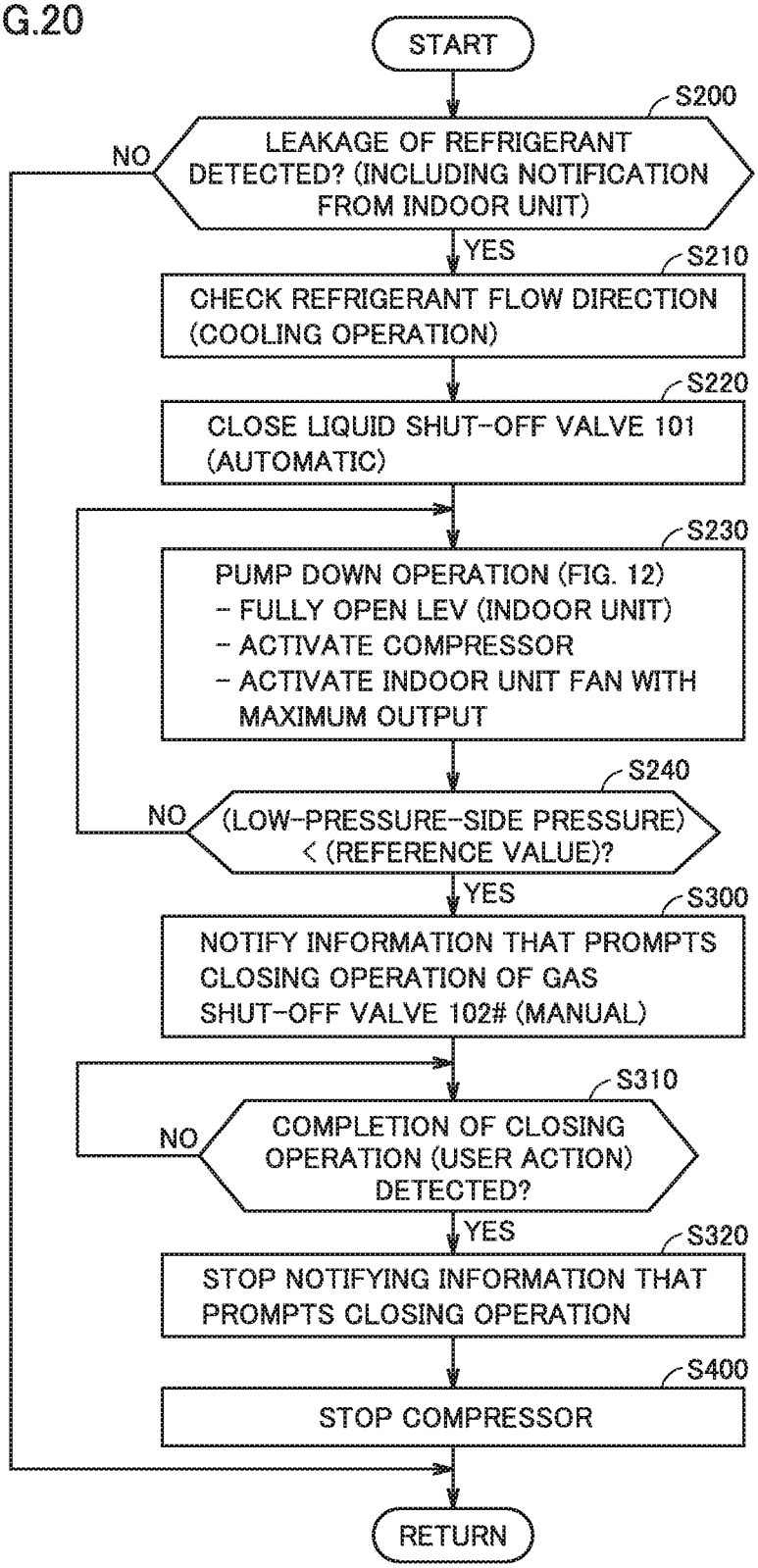
FIG. 20 is a flowchart for explaining a control process of the refrigerant recovery operation in the refrigeration cycle apparatus in embodiment 2.

FIG. 20 is a flowchart for explaining a control process of the refrigerant recovery operation in the refrigeration cycle apparatus in embodiment 2.

With reference to FIG. 20, when a leakage of refrigerant is detected (YES at S200), control device 300 executes the pump down operation until the low-pressure-side pressure drops below a reference value, by steps S210 to S240 identical to those of FIG. 7.

When the low-pressure-side pressure drops below the reference value by the pump down operation (YES at S240), control device 200 advances the process to step S300, and notifies the user, corresponding to outdoor unit 2, of the information that prompts the closing operation of shut-off valve 102#. For example, a message that prompts the closing operation is visually and/or aurally outputted to the user, using information output device 320 of system remote control 310. A message that prompts the closing operation of shut-off valve 102# may be further outputted from information output device 220 of indoor remote control 210.

The information that prompts the closing operation of the gas shut-off valve notified to the user at step S300 corresponds to the "fourth information". The user corresponding to outdoor unit 2 refers to an operator of shut-off valve 102#, including a maintenance administrator or serviceman.

An instruction for stopping the notification of information by step S300 can be inputted through a specific switch among a plurality of operation switches 316 of system remote control 310. In this case, the information notified at step S300 preferably includes a message that prompts operation of the switch when the user corresponding to outdoor unit 2 completes the closing operation of shut-off valve 102#. This specific switch corresponds to one example of the "third operation unit".

After control device 300 notifies the information that prompts the closing operation of shut-off valve 102# by step S300, control device 300 determines, by step S310, whether or not the closing operation (i.e., the user action) by the user corresponding to outdoor unit 2 has been detected.

Figure 21:
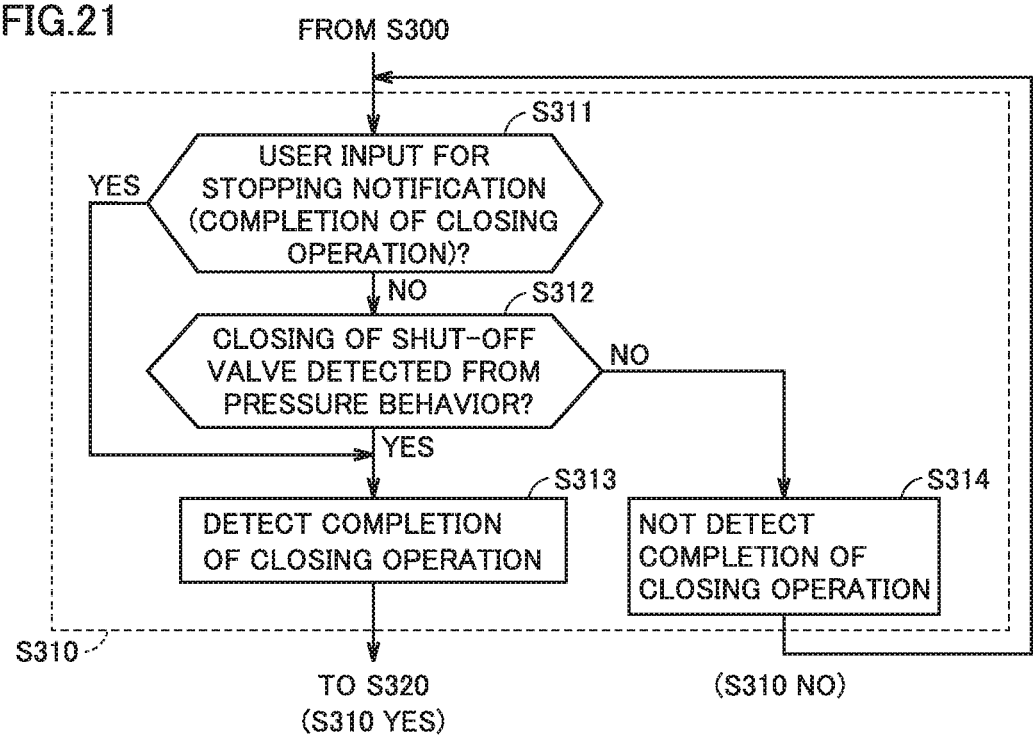
FIG. 21 is a flowchart explaining a first example of the process for detecting the completion of closing operation shown in FIG. 20.

FIG. 21 shows a flowchart explaining a first example of the process for detecting the completion of closing operation at step S310 in FIG. 20.

With reference to FIG. 21, control device 300 executes the processes of steps S311 to S314 for detecting the completion of closing operation.

At step S311, control device 300 determines whether or not the user input has been detected that instructs stop of notification of information that prompts the closing operation. For example, the determination at step S311 is executed based on the presence or absence of the operation on the above-described specific switch.

At step S312, control device 200 determines whether or not the closing of shut-off valve 102# has been detected, based on the pressure behavior on the input side relative to compressor 10 while compressor 10 is activated.

For example, the determination at step S312 can be executed based on the detection value from a pressure sensor disposed on the indoor unit side relative to shut-off valve 102# in the circulation pathway of refrigerant. Referring back to FIG. 19, the determination can be executed using a pressure sensor 203 disposed in extension pipe 90, for example. The detection value from pressure sensor 203 is sent to control device 200 (200A). Control device 300 can obtain the detection value from pressure sensor 203 via communication path 7 shown in FIG. 2.

Figure 22:
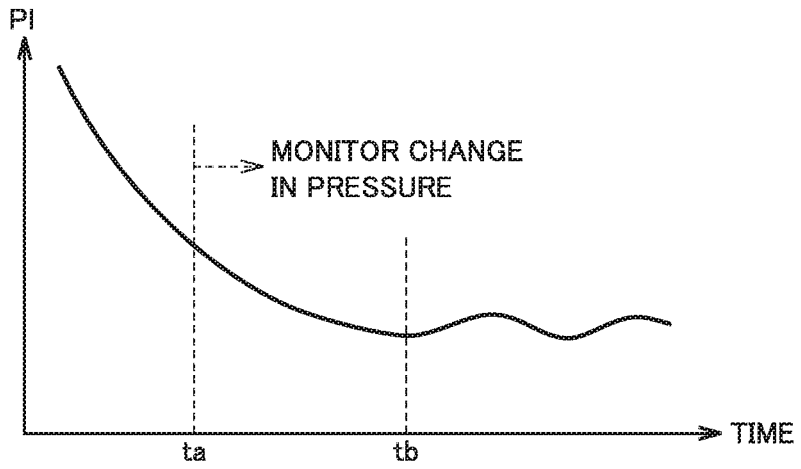
FIG. 22 is a conceptual wave-form chart explaining the pressure behavior of when a gas shut-off valve is closed.

FIG. 22 shows a conceptual wave-form chart explaining the pressure behavior of when shut-off valve 102# (gas shut-off valve) is closed.

With reference to FIG. 22, the activation of compressor 10 in the pump down operation causes a gradual decrease in pressure detection value P1 from pressure sensor 203 located on the input side relative to compressor 10. Once the notification of information that prompts the closing operation of shut-off valve 102# (S300) has been started at time ta, control device 300 monitors subsequent pressure detection value P1. Specifically, the rate of change in pressure detection value P1 with the lapse of time is monitored.

When shut-off valve 102# is closed, the pressure in the pathway on the compressor 10 side relative to shut-off valve 102# continues to decrease due to the activation of compressor 10. However, the pressure in the pathway on the indoor unit 3 side relative to shut-off valve 102# does not decrease in spite of the suction by compressor 10. Accordingly, the closing of shut-off valve 102# can be detected when the rate of change per unit time (which is equivalent to the slope of tangent line at pressure detection value P1 from pressure sensor 203) changes from a negative value into a value around zero. For example, the rate of decrease in pressure detection value P1 is calculated at regular time intervals, and, when the rate of decrease becomes lower than a prescribed value (at time tb in the example in FIG. 22), step S312 (FIG. 21) can be determined to be YES.

Referring back to FIG. 21, when at least any of steps S311 and S312 is determined to be YES, control device 300 advances the process to step S313, where the completion of closing operation of shut-off valve 102# by the user (outdoor unit) is detected. Accordingly, step S310 is determined to be YES, and the process is advanced to step S320 (FIG. 20).

On the other hand, when both of steps S311 and S312 are determined to be NO, the process is advanced to step S314, where the completion of closing operation of shut-off valve 102# is not detected. Accordingly, step S310 is determined to be NO, and control device 300 executes the determination by steps S311 to S315 again after a lapse of prescribed time.

According to the example in FIG. 21, the completion of closing operation of shut-off valve 102# can be detected based on the input of instruction for stopping the notification from the user (corresponding to outdoor unit 2) (S311), and based on the pressure behavior (S312).

Referring back to FIG. 20, when control device 300 detects the completion of closing operation of shut-off valve 102# (YES at S310), control device 300 advances the process to step S320, and stops notifying the information that prompts the closing operation. From that point forward, the output of the information to the user (outdoor unit) using information output device 320 is stopped. Then, control device 300 stops compressor 10 by step S400. When compressor 10 stops, the recovered refrigerant is no longer sucked on the input side relative to compressor 10. However, closed shut-off valve 102# can prevent the recovered refrigerant from flowing backward through extension pipe 90 into indoor unit 3.

Until the completion of closing operation of shut-off valve 102# (i.e., the completion of the user action) is detected (NO at S310), control device 300 continues notifying the user of information that prompts the closing operation (S300).

If step S310 continues being determined to be NO for a period of time longer than prescribed time, the process preferably skips to step S400 to forcibly stop compressor 10 for protecting compressor 10. In this case, at step S400, an abnormality message is preferably provided to notify that compressor 10 has stopped with no detection of the completion of closing operation of shut-off valve 102#.

Thus, as with embodiment 1 and its variations, the refrigeration cycle apparatus in embodiment 2 can output the guidance information to the user corresponding to indoor unit 3 when a leakage of refrigerant is detected by refrigerant leakage sensor 4. Also, at the end of the pump down operation for refrigerant recovery, the refrigeration cycle apparatus in embodiment 2 outputs the information that prompts the closing operation of manual shut-off valve 102# (gas shut-off valve) to the user corresponding to outdoor unit 2. Thus, the user guidance can be appropriately performed.

Figure 23:
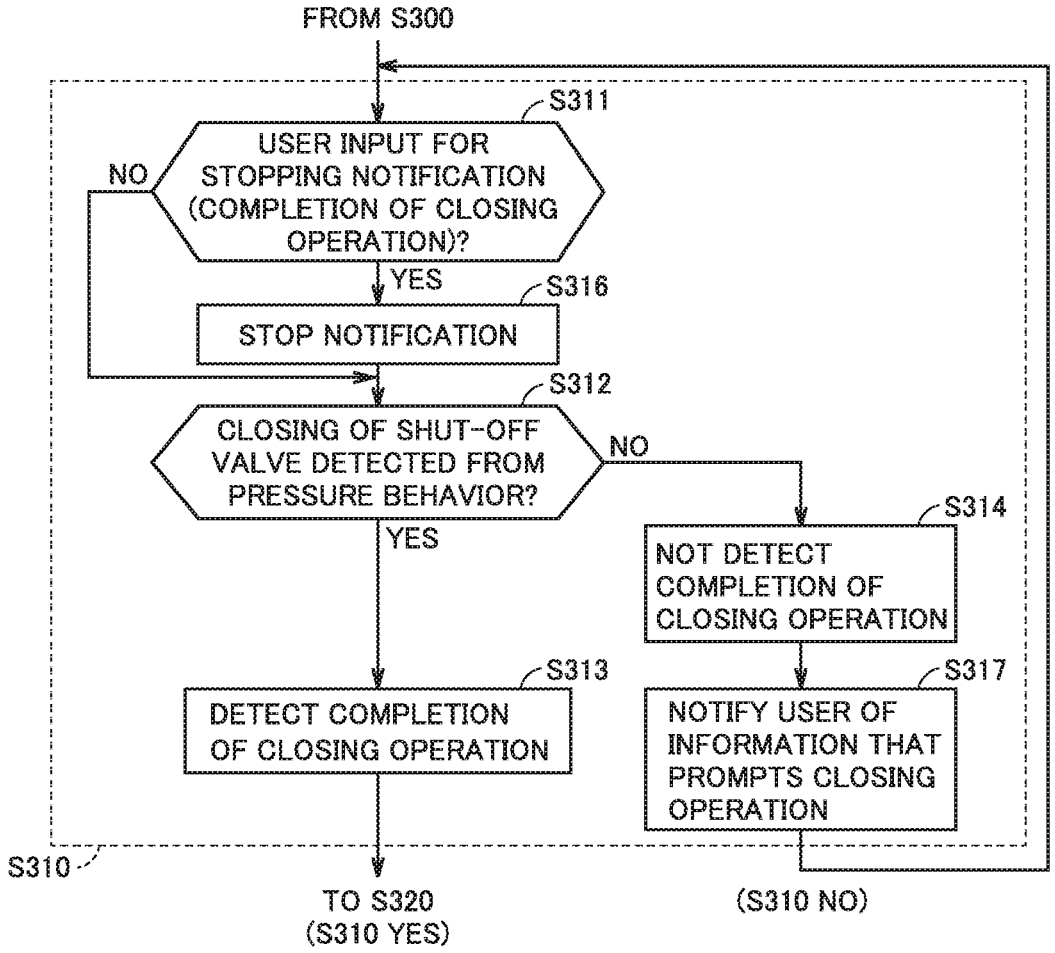
FIG. 23 is a flowchart explaining a second example of the process for detecting the completion of closing operation shown in FIG. 20.
Figure 24:
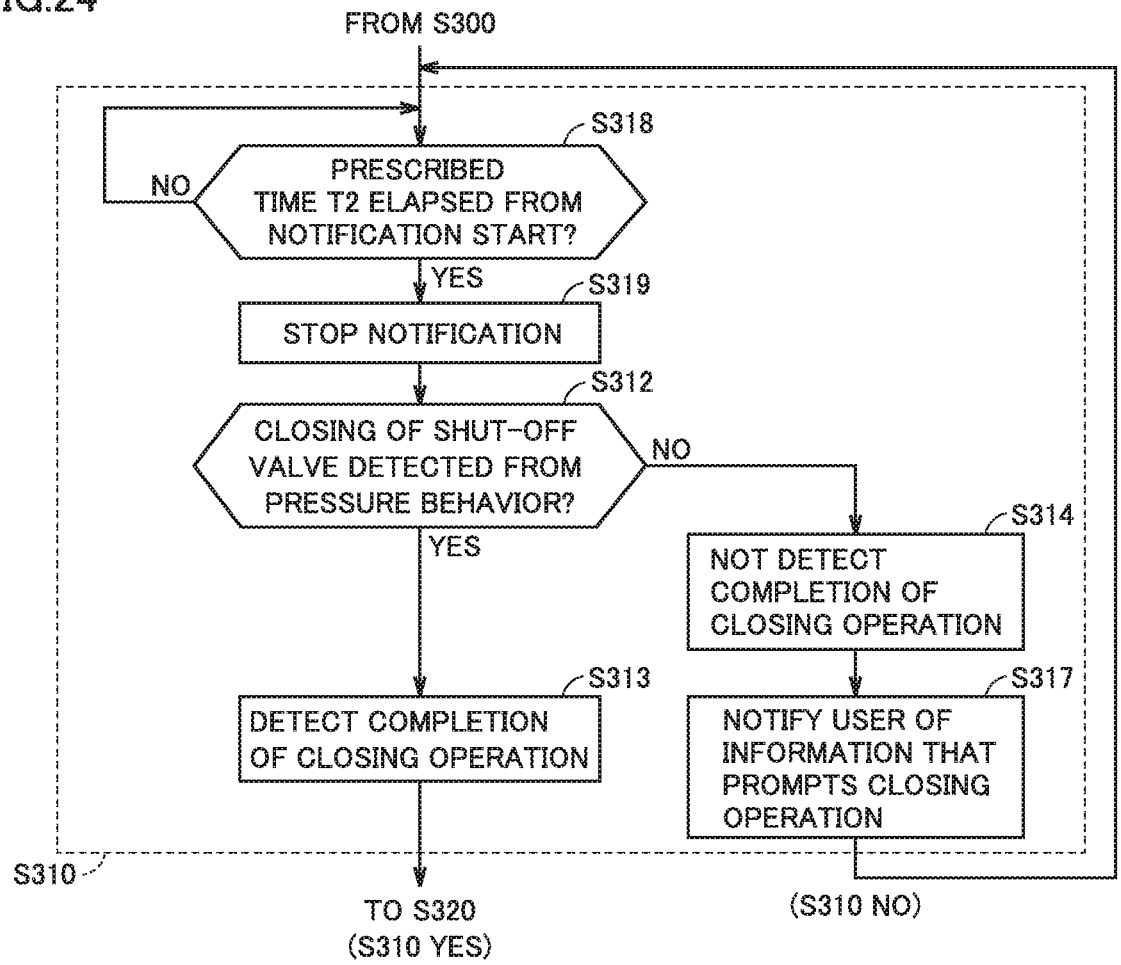
FIG. 24 is a flowchart explaining a third example of the process for detecting the completion of closing operation shown in FIG. 20.

The process for detecting the completion of closing operation at step S310 in FIG. 20 may be modified as in FIG. 23 and FIG. 24.

FIG. 23 shows a flowchart explaining a second example of the process for detecting the completion of closing operation.

With reference to FIG. 23, in the second example, step S310 for detecting the closing operation includes steps S316 and S317, in addition to steps S311 to S314 identical to those of FIG. 21.

When the user input for instructing the stop of notification is detected (YES at S311), control device 300 stops notifying the information that prompts the closing operation of shut-off valve 102# (S300) by step S316. After the stop of notification, control device 300 determines, by step S312 identical to that of FIG. 21, whether or not the closing of shut-off valve 102# has been detected based on the behavior of pressure detection value P1 from pressure sensor 203. For example, based on the rate of change (rate of decrease) in pressure detection value P1 within a predetermined period of time, it can be determined whether or not the pressure continues to decrease with the activation of compressor 10 (i.e., whether or not shut-off valve 102# is open).

Then, when the closing of shut-off valve 102# is detected (YES at S312), control device 300 advances the process to step S313 and detects the completion of closing operation of shut-off valve 102#. Accordingly, step S310 is determined to be YES.

On the other hand, when the closing of shut-off valve 102# is not detected from the pressure behavior (NO at S312), control device 300 does not detect the completion of closing operation of shut-off valve 102# at step S314, and advances the process to step S317 to notify the user of the information that prompts the closing operation. Accordingly, the information that prompts the closing operation, which was stopped at step S316, is notified to the user (outdoor unit) again. In this case, step S316 may output a message different from that of step S300 (e.g., "the gas shut-off valve has not been closed") to prompt the closing operation. Alternatively, step S316 may output a message identical to that of step S300 again.

When the user operation that instructs the stop of notification is not detected (NO at S311), control device 300 skips step S316 and advances the process to step S312. In this case, when the closing of shut-off valve 102# is not detected from the pressure behavior (NO at S312), step S317 notifies the user of the information that prompts the closing operation. In this case, the notification of information that prompts the closing operation, which was started by step S300, is preferably continued. Accordingly, step S310 is determined to be NO, and the process is returned to step S311 again.

According to the second example shown in FIG. 23, when the notification is stopped by the user instruction but the closing of shut-off valve 102# is not detected from the pressure behavior, then the information that prompts the closing operation can be notified to the user again. Thus, the determination of whether the closing of manual shut-off valve 102# has completed depends not only on the user but also on the actual pressure behavior. Therefore, appropriate user guidance can be provided.

FIG. 24 shows a flowchart explaining a third example of the process for detecting the completion of closing operation.

With reference to FIG. 24, in the third example, control device 300 determines, by step S318, whether or not prescribed time T2 has elapsed from the start of notification by step S300. When prescribed time T2 has elapsed (YES at S318), control device 300 automatically stops notifying the information that prompts the closing operation of shut-off valve 102# (S300) by step S319. On the other hand, until prescribed time T2 has elapsed (NO at S318), the notification of information that prompts the closing operation of shut-off valve 102# (S300) continues without execution of step S319.

After the stop of notification by step S319, control device 300 executes steps S312 to S314, S317 identical to those of FIG. 23. When the closing of shut-off valve 102# is detected from the pressure behavior (YES at S312), the completion of the closing operation is detected by step S313. Accordingly, step S310 is determined to be YES.

On the other hand, when the closing of shut-off valve 102# is not detected from the pressure behavior after the notification was stopped (NO at S312), then control device 300 does not detect the completion of closing operation (S314), and executes step S317 identical to that of FIG. 23. Further, control device 300 determines step S310 to be NO, and returns the process to step S318.

According to the third example shown in FIG. 24, after prescribed time T2 (S318) has elapsed, the notification of information that prompts the closing operation of shut-off valve 102# is automatically stopped, and, based on the pressure behavior at this point of time, the information that prompts the closing operation can be notified to the user again. Thus, stopping notifying the information every prescribed time T2 can alleviate the user's discomfort that would be caused by long-time continuing notification.

Variation 1 of Embodiment 2

Refrigeration cycle apparatus 1*c* shown in embodiment 2 continues to operate compressor 10 until determining the completion of closing operation of manual shut-off valve 102. Variation 1 of embodiment 2 describes a refrigerant recovery operation including additional control for protecting compressor 10 at the end of the pump down operation.

Figure 25:
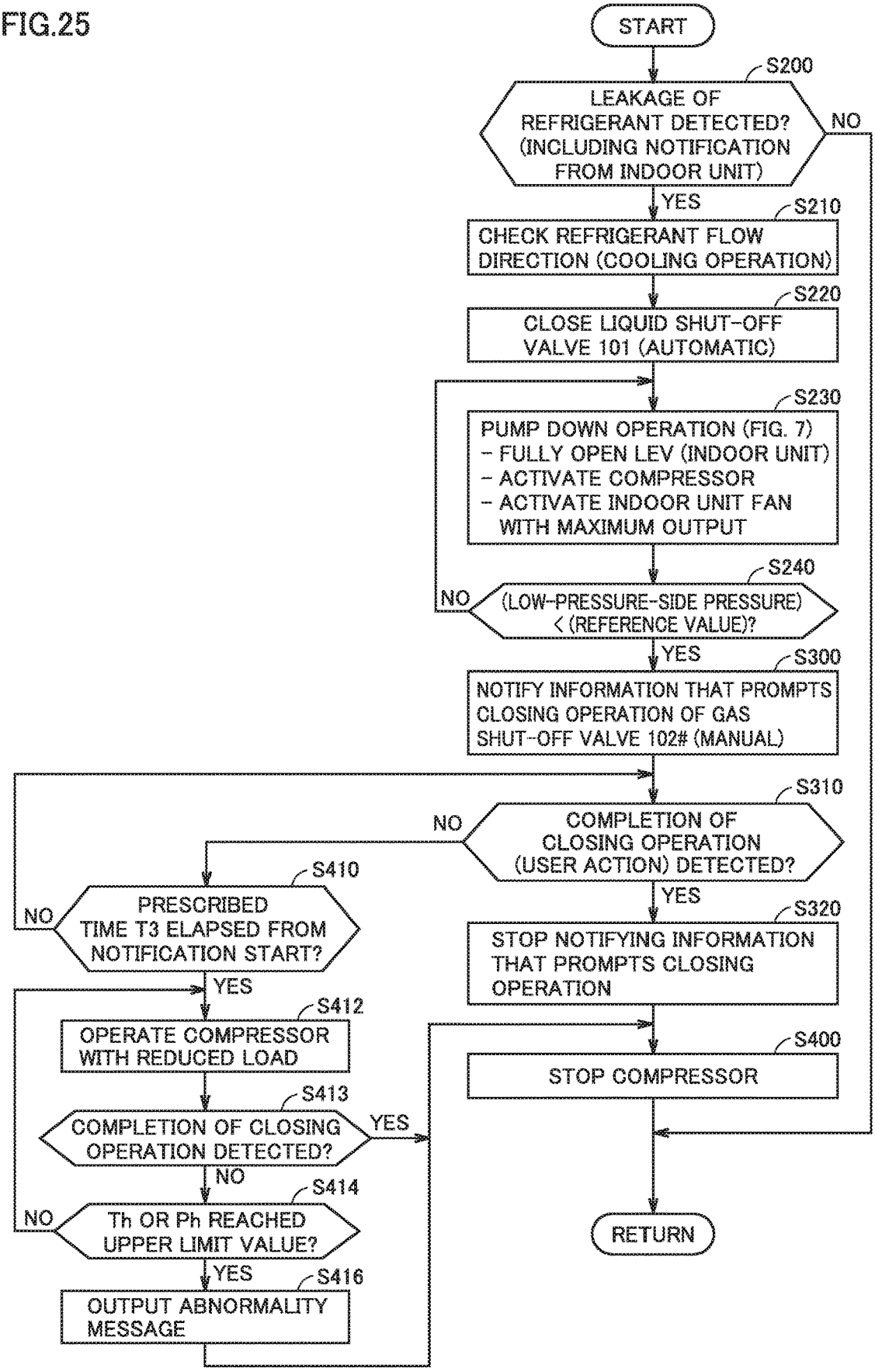
FIG. 25 is a flowchart for explaining a control process of the refrigerant recovery operation in variation 1 of embodiment 2.

FIG. 25 is a flowchart for explaining a control process of the refrigerant recovery operation in variation 1 of embodiment 2.

With reference to FIG. 25, by the processes of steps S200 to S300 identical to those of FIG. 20, control device 300 notifies, by step S300, the user of the information that prompts the closing operation of shut-off valve 102# at the end of the pump down operation.

After that, until the closing operation by the user is detected by the determination at step S310 (NO at S310), control device 300 executes the processes of steps S410 to S416.

At step S410, control device 300 determines whether or not prescribed time T3 has elapsed from the start of the notification of information by step S300. Until prescribed time T3 has elapsed (NO at S410), control device 300 continues the determination by step S310 while operating compressor 10.

On the other hand, when prescribed time T3 has elapsed (YES at S410), control device 300 advances the process to step S412 and changes the operational state to reduce the load on compressor 10. For example, step S412 can reduce the operating frequency so that the load on compressor 10 can be reduced compared to when the notification is started by step S300. Alternatively, step S412 can open a bypass (not shown) provided beforehand between the low-pressure side and the high-pressure side relative to compressor 10, so as to operate compressor 10 with reduced load.

Step S412 can reduce the operation load to avoid a breakdown of compressor 10 when compressor 10 has been continuously operating after the low-pressure-side pressure decreased (S240).

While the compressor 10 continues to operate with reduced load, control device 300 determines the presence or absence of the closing operation of shut-off valve 102# by step S413. For example, step S413 detects the closing operation of shut-off valve 102# by the user based on the pressure behavior, as with step S312 (e.g., FIG. 21).

When the closing operation of shut-off valve 102# is detected (YES at S413), control device 300 stops operating compressor 10 by step S400 and ends the process. On the other hand, when the closing operation of shut-off valve 102# is not detected (NO at S413), control device 300 determines, by step S414, whether or not the pressure (discharge pressure) Ph or the temperature (discharge temperature) Th on the output side relative to compressor 10 has reached a predetermined upper limit value. The determination by step S414 can be executed using the detection values from pressure sensor 110 and temperature sensor 106.

When discharge pressure Ph or discharge temperature Th has risen to the upper limit value (YES at S414), control device 300 outputs an abnormality message by step S416, and advances the process to step S400 to stop operating compressor 10. Step S416 outputs, to the user, the information indicating that compressor 10 has been forced to stop before the closing of shut-off valve 102# is confirmed, for protecting compressor 10.

Until discharge pressure Ph or discharge temperature Th has risen to the upper limit value (NO at S414), control device 300 continues operating compressor 10 with reduced load by step S412.

The refrigerant recovery operation in variation 1 of embodiment 2 can bring about the advantageous effects of the user guidance identical to those of embodiment 2, and can also prevent breakdown of compressor 10 that would be caused when manual shut-off valve 102# (gas shut-off valve) is not closed at the end of the pump down operation.

Variation 2 of Embodiment 2

Figure 26:
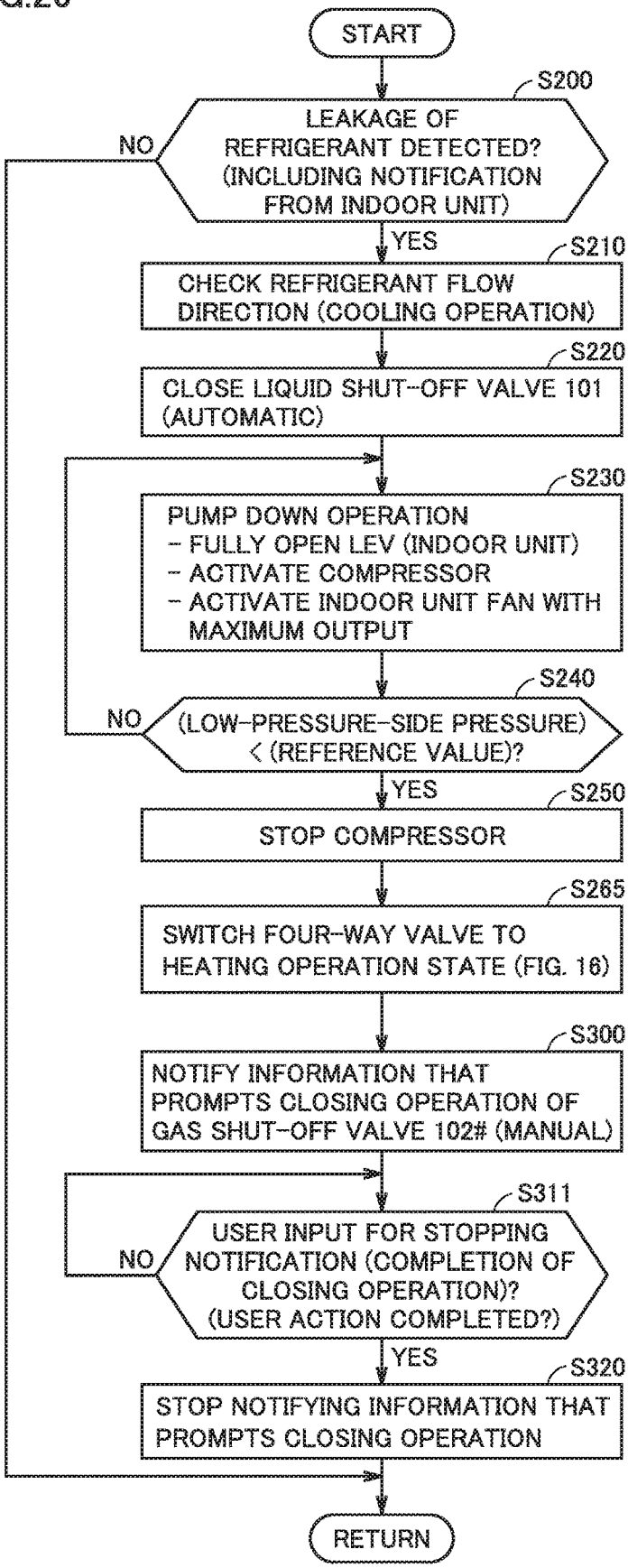
FIG. 26 is a flowchart for explaining a control process of the refrigerant recovery operation in variation 2 of embodiment 2.

FIG. 26 is a flowchart for explaining a control process of the refrigerant recovery operation in variation 2 of embodiment 2.

With reference to FIG. 26, control device 200 executes steps S200 to S250 identical to those of FIG. 11. Thus, the pump down operation starts in response to the detection of leakage of refrigerant and continues until the low-pressure-side pressure detected by pressure sensor 104 drops below a predetermined reference value (NO at S240).

When the low-pressure-side pressure drops below the reference value (YES at S240), control device 200 stops compressor 10 by step S250 and switches four-way valve 100 from state 1 (cooling operation state) to state 2 (heating operation state) by step S265, as with FIG. 15.

Thus, stopped compressor 10 can shut off the refrigerant pathway between accumulator 108 and indoor unit 3. The refrigerant can be prevented from flowing backward from outdoor unit 2 into indoor unit 3 through shut-off valve 102#.

Further, in order to fully shut off the refrigerant pathway from outdoor unit 2 to indoor unit 3, control device 200 notifies the user of the information that prompts the closing operation of shut-off valve 102# by step S300, as with FIG. 20.

While step S300 is outputting the information that prompts the closing operation of shut-off valve 102#, control device 200 determines, by step S311 identical to that of FIG. 21 and FIG. 23, whether or not the user input has been detected that instructs the stop of notification of information that prompts the closing operation. For example, as described above, the determination at step S311 can be executed based on the presence or absence of input to a specific switch to be operated by the user corresponding to outdoor unit 2 at the time of completion of closing operation.

After four-way valve 100 is switched to state 2 (heating state), it is difficult to determine whether or not shut-off valve 102# has been closed based on the pressure behavior as in step S312 in FIG. 21 and FIG. 23.

When control device 200 detects the user input that indicates the completion of closing operation of shut-off valve 102# (YES at S311), control device 200 advances the process to step S320, and stops notifying the information that prompts the closing operation. From that point forward, the output of the information to the user using information output device 320 is stopped. Closed shut-off valve 102# can more reliably prevent the recovered refrigerant from flowing backward through extension pipe 90 into indoor unit 3.

On the other hand, until control device 200 detects the user input that indicates the completion of closing operation of shut-off valve 102# (NO at S311), control device 200 continues notifying the user of the information that prompts the closing operation (S300).

At this stage, four-way valve 100 has been switched to state 2 (heating state), in which a refrigerant backflow into indoor unit 3 does not occur. The purpose of the closing of manual shut-off valve 102# is to more reliably prevent a backflow. Accordingly, after a lapse of certain time (e.g., equivalent to prescribed time T2 at step S318) from the start of the notification of information that prompts the closing operation, then step S311 can be forcibly determined to be YES to stop the notification of information.

Thus, according to the refrigerant recovery operation in variation 2 of embodiment 2, the user guidance can be performed so that the refrigerant recovered in outdoor unit 2 can be more reliably prevented from flowing backward into indoor unit 3 at the end of the pump down operation in response to the detection of leakage of refrigerant.

The present embodiment shows, by example, a refrigeration cycle apparatus that has four-way valve 100 to switch between the cooling operation state and the heating operation state. However, in some embodiments, the description can be applied to refrigeration cycle apparatuses designed exclusively for cooling operation or heating operation. Specifically, the control for outputting the guidance information and the control for the pump down operation in the present embodiment can be applied, except for the examples in FIG. 14 to FIG. 16 and FIG. 26 that involve using four-way valve 100.

It should be understood that the embodiments disclosed herein are by way of example in every respect, not by way of limitation. The scope of the present invention is defined not by the above description but by the terms of the claims, and is intended to include any modification within the meaning and scope equivalent to the terms of the claims.

The invention claimed is:

1. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action, wherein the guidance information includes first information that prompts the user to execute ventilation in the space, wherein the controller performs a ventilation determination function to determine whether or not the ventilation has been executed by the user after the first information output device outputs the first information, wherein the first information output device is configured to, after starting to output the first information, continue outputting the first information until the ventilation determination function detects execution of the ventilation, wherein the refrigeration cycle apparatus further comprises a first operation input device configured to receive, from the user, an instruction for stopping output of the first information, and wherein the first information output device is configured to continue outputting the first information until the ventilation determination function detects execution of the ventilation, after the first operation input device receives the instruction for stopping output of the first information.

2. The refrigeration cycle apparatus according to claim 1, wherein the first information output device is configured to, after starting to output the first information, stop outputting the first information when the ventilation determination function detects execution of the ventilation.

3. The refrigeration cycle apparatus according to claim 1, further comprising the first operation input device configured to receive, from the user, an instruction for stopping output of the first information, wherein the first information output device is configured to stop outputting the first information in response to the instruction for stopping output of the first information received by the first operation input device.

4. The refrigeration cycle apparatus according to claim 1, wherein the ventilation determination function determines whether or not the ventilation in the space has been executed, based on a drop in refrigerant concentration in the space.

5. The refrigeration cycle apparatus according to claim 1, wherein the ventilation determination function determines whether or not the ventilation in the space has been executed, based on a change in temperature in the space.

6. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action wherein the guidance information includes first information that prompts the user to execute ventilation in the space, wherein the controller performs a ventilation determination function to determine whether or not the ventilation has been executed by the user after the first information output device outputs the first information, wherein the first information output device is configured to, after starting to output the first information, continue outputting the first information until the ventilation determination function detects execution of the ventilation, wherein the refrigeration cycle apparatus further comprises a first operation input device configured to receive, from the user, an instruction for stopping output of the first information, wherein the first information output device is configured to stop outputting the first information in response to the instruction for stopping output of the first information received by the first operation input device, and wherein the first information output device is configured to, after stopping outputting the first information in response to the instruction to the first operation unit input device, output the first information again when the ventilation determination function determines that the ventilation has not been executed.

7. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action, wherein the guidance information includes second information that prompts a contact with a maintenance administrator of the refrigeration cycle apparatus, so as to let the maintenance administrator know that the leakage of refrigerant has been detected, wherein the refrigeration cycle apparatus further comprises a second operation input device configured to be operated by the maintenance administrator, and wherein the first information output device is configured to, after starting to output the second information, continue outputting the second information until the second operation input device is operated.

8. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action wherein the first information output device is configured to, when the leakage detector detects the leakage of refrigerant, output third information that notifies the user of a ban on using fire in the space, in addition to the guidance information, and wherein the first information output device is configured to, after stopping outputting the guidance information, continue outputting the third information.

9. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action wherein the refrigeration cycle apparatus further comprises a four-way valve having a first port connected to a pathway leading to a refrigerant intake side of the compressor, a second port connected to a pathway leading to the outdoor heat exchanger, a third port connected to a refrigerant discharge side of the compressor, and a fourth port connected to a pathway leading to the indoor heat exchanger, wherein the first shut-off valve is configured to be automatically opened and closed in accordance with an instruction from the controller, wherein the four-way valve is configured to be controlled to switch between a first state and a second state, the first state being a state in which the first port communicates with the fourth port, and the second port communicates with the third port, the second state being a state in which the first port communicates with the second port, and the third port communicates with the fourth port, wherein when the leakage detector detects the leakage of refrigerant, then the four-way valve is controlled into the first state, and a refrigerant recovery operation is started in which the compressor is activated while the first shut-off valve is closed, and wherein when a pressure detection value on a low-pressure side relative to the compressor drops below a prescribed value during the refrigerant recovery operation, then the four-way valve is controlled into the second state, and the compressor is stopped, thus ending the refrigerant recovery operation.

10. The refrigeration cycle apparatus according to claim 9, further comprising:

a second shut-off valve provided in a pathway that connects the fourth port of the four-way valve and the indoor heat exchanger; and a second information output device configured to output information to a user corresponding to the outdoor unit, wherein the second shut-off valve is configured to be manually opened and closed, and wherein the second information output device is configured to, after ending of the refrigerant recovery operation, output fourth information that prompts a closing operation of the second shut-off valve.

11. The refrigeration cycle apparatus according to claim 10, further comprising a third operation input device configured to be operated when the user corresponding to the outdoor unit completes the closing operation of the second shut-off valve, wherein the second information output device is configured to, after starting to output the fourth information, stop outputting the fourth information when the third operation input device is operated.

12. A refrigeration cycle apparatus including an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe connecting the compressor, the outdoor heat exchanger, and the indoor heat exchanger;

a first shut-off valve provided in a pathway that connects the outdoor heat exchanger and the indoor heat exchanger not via the compressor in a refrigerant circulation pathway formed by the compressor, the outdoor heat exchanger, the indoor heat exchanger, and the refrigerant pipe;

a leakage detector configured to detect a leakage of refrigerant flowing through the refrigerant pipe;

an alarm configured to emit a warning sound in response to detection of the leakage of refrigerant by the leakage detector;

a safety measure device including at least any of a mechanical ventilation device configured to forcibly ventilate a space in which the indoor unit is disposed, a refrigerant shut-off device provided separately from the first shut-off valve, and configured to shut off supply of the refrigerant to the space, and an agitating device configured to convect air in the space;

a first information output device configured to output information to a user corresponding to the indoor unit; and a controller configured to control operation of the refrigeration cycle apparatus, wherein the alarm and the safety measure device are configured to be activated when the leakage detector detects the leakage of refrigerant, wherein the first information output device is configured to output guidance information when the leakage detector detects the leakage of refrigerant, the guidance information being for notifying a user action to be taken after the safety measure device takes a safety measure, wherein the first information output device is configured to, after outputting the guidance information, stop outputting the guidance information in response to completion of the user action, wherein the refrigeration cycle apparatus further comprises:

a second shut-off valve provided in a pathway that connects the outdoor heat exchanger and the indoor heat exchanger via the compressor in the refrigerant circulation pathway; and a second information output device configured to output information to a user corresponding to the outdoor unit, wherein the first shut-off valve is configured to be automatically opened and closed in accordance with an instruction from the controller, wherein the second shut-off valve is configured to be manually opened and closed, wherein when the leakage detector detects the leakage of refrigerant, a refrigerant recovery operation is executed in which the compressor is activated after the first shut-off valve is closed while the refrigerant circulation pathway is formed in a direction such that the refrigerant discharged from the compressor flows through the outdoor heat exchanger and then through the indoor heat exchanger, wherein the second information output device is configured to, when a pressure detection value on a low-pressure side relative to the compressor drops below a prescribed value during the refrigerant recovery operation, output fourth information that prompts a closing operation of the second shut-off valve, and wherein the second information output device is configured to, after outputting the fourth information, stop outputting the fourth information in response to completion of the closing operation of the second shut-off valve.

13. The refrigeration cycle apparatus according to claim 12, further comprising a third operation input device configured to be operated when the user corresponding to the outdoor unit completes the closing operation of the second shut-off valve, wherein the second information output device is configured to, after starting to output the fourth information, stop outputting the fourth information by detecting completion of the closing operation when the third operation input device is operated or when a rate of decrease in the pressure detection value becomes lower than a prescribed value.

14. The refrigeration cycle apparatus according to claim 13, wherein the compressor is configured to stop when completion of the closing operation is detected after the second information output device starts to output the fourth information.

15. The refrigeration cycle apparatus according to claim 14, wherein, after the second information output device starts to output the fourth information and before completion of the closing operation is detected, there is a period during which the compressor continues being activated with load being reduced compared to when output of the fourth information is started.

16. The refrigeration cycle apparatus according to claim 15, wherein the compressor is configured to stop when a pressure detection value or a temperature detection value of the refrigerant on a refrigerant output side relative to the compressor becomes higher than a prescribed upper limit value while the second information output device is outputting the fourth information before completion of the closing operation is detected.

* * * * *